US011452362B2

(12) United States Patent
Livingston et al.

(10) Patent No.: US 11,452,362 B2
(45) Date of Patent: Sep. 27, 2022

(54) CONVERTIBLE HIP BELT AND BACKPACK SYSTEM FOR EFFICIENT TRAVEL

(71) Applicant: Gravel, LLC, Provo, UT (US)

(72) Inventors: Chris Livingston, Provo, UT (US); Lance Williams, Provo, UT (US); Henry Lee, Provo, UT (US); Monika Robinson, Pleasant Grove, UT (US); Ethan Powell, Salt Lake City, UT (US); Polina Piddubna, Provo, UT (US); McKenzie Briscoe, Provo, UT (US); Bryan Howell, Park City, UT (US); Brooke Fisher, Provo, UT (US)

(73) Assignee: Gravel, LLC, Provo, UT (US)

( * ) Notice: Subject to any disclaimer, the term of this patent is extended or adjusted under 35 U.S.C. 154(b) by 0 days.

(21) Appl. No.: 17/211,462

(22) Filed: Mar. 24, 2021

(65) Prior Publication Data

US 2021/0298460 A1 Sep. 30, 2021

Related U.S. Application Data

(60) Provisional application No. 63/002,244, filed on Mar. 30, 2020.

(51) Int. Cl.
*A45F 4/02* (2006.01)
*A45F 3/04* (2006.01)
(Continued)

(52) U.S. Cl.
CPC ..... *A45F 4/02* (2013.01); *A45F 3/005* (2013.01); *A45F 3/04* (2013.01); *A45F 3/02* (2013.01);
(Continued)

(58) Field of Classification Search
CPC ..... A45F 2004/023; A45F 2003/045; A45F 2003/144
(Continued)

(56) References Cited

U.S. PATENT DOCUMENTS 5,603,441 A 2/1997 Easter
5,725,139 A 3/1998 Smith
(Continued)

FOREIGN PATENT DOCUMENTS

JP 3390414 B2 * 3/2003
JP 2014183881 A * 10/2014

OTHER PUBLICATIONS

Osprey, Farpoint Travel Pack 70, https://www.osprey.com/us/en/product/farpoint-70-FARPNT70.html, Osprey, last visited Jun. 25, 2021, available at least as early as Feb. 14, 2020, 2 pages.

*Primary Examiner* — Scott T McNurlen
(74) *Attorney, Agent, or Firm* — Kunzler Bean & Adamson; Thomas D. Briscoe

(57) ABSTRACT

A convertible hip belt and backpack system for efficient travel include an apparatus with the convertible hip belt. The system includes a backpack having a main compartment and right and left shoulder straps. The system further includes a convertible hip belt having a backpack mode and an independent mode. In the backpack mode, the convertible hip belt includes a right hip pocket and a left hip pocket detachably coupled to the backpack. The convertible hip belt includes a separable fastener that adjustably couples a strap end of the right hip pocket to a strap end of the left hip pocket. In the independent mode, the convertible hip belt is decoupled from the backpack and the right and left hip pockets are instead coupled to each other.

18 Claims, 15 Drawing Sheets

(51) Int. Cl.
*A45F 3/00* (2006.01)
*A45F 3/02* (2006.01)

(52) U.S. Cl.
CPC ... *A45F 2003/045* (2013.01); *A45F 2004/023* (2013.01)

(58) Field of Classification Search
USPC ..... 224/648–649, 660, 662–664, 637, 577, 224/153, 578–575
See application file for complete search history.

(56) References Cited

U.S. PATENT DOCUMENTS

| | | | | |
|---|---|---|---|---|
| 5,799,851 | A * | 9/1998 | Wulf | A45F 3/047 224/582 |
| 6,390,348 | B1 * | 5/2002 | Godshaw | B25H 3/00 224/660 |
| D781,573 | S | 3/2017 | Kelly et al. | |
| 10,463,124 | B2 | 11/2019 | Richards et al. | |
| 2002/0113103 | A1 * | 8/2002 | O'Hare | A47C 1/146 224/648 |
| 2002/0139820 | A1 * | 10/2002 | Godshaw | A45F 4/02 224/655 |
| 2006/0060625 | A1 | 3/2006 | Kuder et al. | |
| 2006/0138188 | A1 | 6/2006 | Kramer | |
| 2007/0045370 | A1 * | 3/2007 | Hsieh | A45F 3/04 190/110 |
| 2008/0156604 | A1 * | 7/2008 | Franco | A45C 13/02 190/102 |
| 2012/0111876 | A1 | 5/2012 | Pfotenhauer | |

* cited by examiner

CONVERTIBLE HIP BELT AND BACKPACK SYSTEM FOR EFFICIENT TRAVEL

CROSS-REFERENCES TO RELATED APPLICATIONS

This application claims the benefit of U.S. Provisional Patent Application No. 63/002,244 entitled "CONVERTIBLE HIP BELT AND BACKPACK SYSTEM FOR EFFICIENT TRAVEL" and filed on Mar. 30, 2020 for Chris Livingston et al., which is incorporated herein by reference.

FIELD

This invention relates to travel luggage and more particularly relates to a convertible hip belt and backpack system for efficient travel.

BACKGROUND

Various types of travel luggage exist. Certain types of luggage such as larger wheeled suitcases with wheels that spin or wheeled carry-on suitcases with extendable handles are optimized for carrying clothing and other personal items from a departure point to a destination. Whether checked or carry-on, various suitcases include extendable handles and wheels to support part of the weight of the cargo inside. For example, wheeled suitcases sold under the trademark Rollaboard® are fairly popular. Such wheels and handles add weight to the luggage but also make it easier to move over smooth floors such as found in airports, train stations, and so forth. Other luggage types such as duffel bags or laptop cases often include a shoulder strap as well as handles to better support the weight. Some urban travelers pack an empty daypack, sling pack, or string pack into a suitcase so that when they arrive at their destination, they have something smaller than a suitcase which they can use to carry things as they walk or ride around their destination. Other travelers stow a wheeled carry-on suitcase in a carry-on space and slide a classic student backpack underneath a seat where they can reach it to retrieve items that may be useful during travel.

For outdoor excursions such as hiking, mountaineering, or hunting, a backpack with an internal or external frame, shoulder straps, and/or a hip belt are better options for supporting weight than wheels and extendable handles. Like the urban travelers, some mountaineers pack an empty daypack, sling pack, or string pack into their mountaineering pack so that they can use the smaller pack for shorter trips while leaving their big pack at a base camp. Mountaineering and hunting packs often include various external pockets for carrying items of different types. During a rest break, a hiker or hunter may ask one of her hiking companions to retrieve an item from one of the external pockets that is not conveniently reachable to avoid having to take off the backpack.

SUMMARY

An apparatus that includes a convertible hip belt for efficient travel is disclosed. One or more systems are disclosed that include a backpack and the convertible hip belt of the apparatus.

The apparatus in one example implementation includes a convertible hip belt having a backpack mode and an independent mode. In the backpack mode, the convertible hip belt includes a right hip pocket and a left hip pocket individually having a strap at a strap end and one or more pocket connectors at a pocket-attaching end, the one or more pocket connectors detachably couplable to a complementary connector on a back panel of a backpack. The convertible hip belt further includes a separable fastener that adjustably couples the strap of the right hip pocket to the strap of the left hip pocket such that an inward-facing back of the right hip pocket and/or the left hip pocket is configured to support at least a portion of a load within the backpack against a portion of the waist of a user. In the independent mode, the convertible hip belt is decoupled from the backpack at the one or more pocket connectors of the right hip pocket and the left hip pocket and the one or more pocket connectors are instead coupled to each other.

A system for efficient travel is disclosed. In one example implementation, the system includes a backpack having a main compartment and right and left shoulder straps. The system further includes a convertible hip belt having a backpack mode and an independent mode. In the backpack mode, the convertible hip belt includes a right hip pocket and a left hip pocket detachably coupled to the backpack. The convertible hip belt includes a separable fastener that adjustably couples the strap end of the right hip pocket to the strap end of the left hip pocket. In the independent mode, the convertible hip belt is decoupled from the backpack and the right and left hip pockets are instead coupled to each other.

BRIEF DESCRIPTION OF THE DRAWINGS

So that the advantages of the invention will be readily understood, a more particular description of the invention briefly described above will be rendered by reference to specific example implementations that are illustrated in the appended drawings. Understanding that these drawings depict only typical example implementations of the invention and are not, therefore, to be considered to be limiting of its scope, the invention will be described and explained with additional specificity and detail through the use of the accompanying drawings, in which.

DETAILED DESCRIPTION

Figure 1:
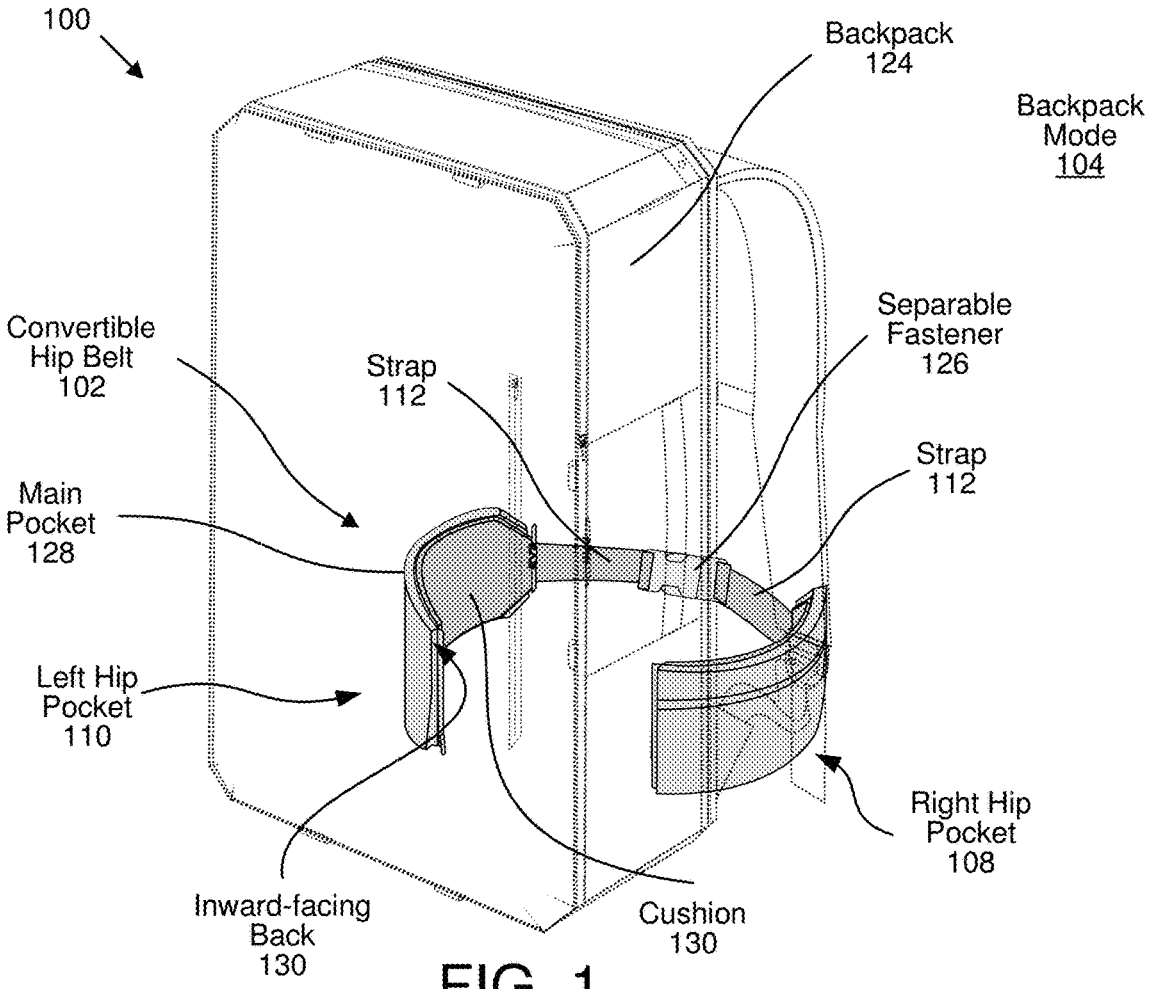
FIG. 1 is a rear perspective view of a convertible hip belt for efficient travel configured in a backpack mode, according to one or more examples of the present disclosure.

Reference throughout this specification to "one example implementation," "an example implementation," or similar language means that a particular feature, structure, or characteristic described in connection with the example implementation is included in at least one example implementation. Thus, appearances of the phrases "in one example implementation," "in an example implementation," and similar language throughout this specification may, but do not necessarily, all refer to the same example implementation, but mean "one or more but not all example implementations" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more example implementations. In the following description, numerous specific details are provided, such as examples of connectors, fasteners, pockets, sleeves, compartments, closures, and so forth, to provide a thorough understanding of example implementations of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

As used herein, a list with the conjunction "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, "one or more of A, B and C" includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B, and C.

Definitions

As used herein, the term "about" refers to a +/−10% variation from the nominal value. It is to be understood that such a variation is always included in any given value provided herein, whether or not it is specifically referred to.

As used herein, the term "clamshell" refers to an enclosure having two members pivotably connected at a hinging axis.

As used herein, the term "carry-on" refers to an enclosure such as a backpack that is configured to meet predetermined airline carry-on baggage maximum size requirements but with no implication as to whether the enclosure can be used in non-airline travel.

Introduction

Providing luggage for efficient travel involves many aspects, such as, for example, providing convenient access to items needed during travel and items used at a travel destination including during travel after arriving at a destination. Different types of luggage may be used for different types of trips or excursions. However, another aspect of efficient travel relates to how much luggage can be carried by an individual traveler.

Vehicles used for travel such as airplanes, trains, cars, cruise ships, and so forth, sometimes have physical space limitations and/or economic limitations that can affect a traveler's access luggage items during travel. For example, limitations on the number of items that may be brought aboard a vehicle by an individual may lead travelers to check luggage in to be transported in an inaccessible cargo space.

Some suitcases have wheels and/or luggage handles that make it easier to transport heavier items or a greater number of items, but such items may not be efficient for travel involving stairs, cobblestone streets, and similar situations.

Backpacks are convenient for carrying school or work laptops, books, and similar items, or for carrying personal items onboard a vehicle such as an airliner. But some backpacks are less suitable for carrying a mixed wardrobe that includes clothing that may get wrinkled. Certain hunting or camping backpacks include a hip belt to help support the weight of hunting or camping equipment used on an outdoor excursion. However, in addition to not being suitable for carrying a mixed wardrobe and other items associated with mixed urban and outdoor travel, hunting and camping backpacks can either be too bulky to easily maneuver in a vehicle or to fit in an onboard carry-on space.

Accordingly, the various example implementations of the present disclosure provide a convertible hip belt and backpack system for efficient travel that addresses various problems, which the authors of the present disclosure have identified with certain existing types of travel luggage such as conventional suitcases and backpacks.

FIG. 1 is a rear perspective view of a convertible hip belt for efficient travel configured in a backpack mode, according to one or more examples of the present disclosure. In one example implementation, an apparatus 100 includes a convertible hip belt 102. The convertible hip belt 102 has a left hip pocket 110 and a right hip pocket 108. In certain example implementations, the left hip pocket 110 and right hip pocket 108 individually have a strap 112 at a strap end 114 and one or more pocket connectors 116 at a pocket-attaching end 118 as described below with respect to FIG. 3. In such example implementations, the one or more pocket connectors 116 are detachably coupled to a complementary connector (e.g., another pocket connector 116) on a back panel 122 of a backpack 124 as described below with respect to FIG. 3.

In various example implementations, the convertible hip belt 102 includes a separable fastener 126, such as, for example, a side release buckle that adjustably couples the strap 112 of the right hip pocket 108 to the strap 112 of the left hip pocket 110 such that an inward-facing back 132 of the right hip pocket 108 and/or the left hip pocket 110 is configured to support at least a portion of a load within the backpack 124 against a portion of the waist of a user.

In certain example implementations, a cushion 130 is attached to the inward-facing back 132 of the right hip pocket 108 and/or the left hip pocket 110. As can be seen in FIG. 1, in various example implementations, the cushion 130 is relatively thin compared with padding on hip belts for hiking and camping backpacks. For example, in some implementations, the thickness of the cushion 130 is between 0.2 inch and 0.7 inch. A loaded backpack for hiking or camping may weigh as much as 20% of a person's body weight. So, for example, a 200-pound person may be carrying a 40-pound load in their backpack and may need a thicker cushion on a hip belt for a hiking or camping backpack. In contrast, as recognized by the authors of this disclosure, the convertible hip belt 102 can satisfactorily utilize a thinner cushion 130 since a predetermined maximum weight limit for carry-on luggage may be as low as 22 pounds.

In one example implementation, the right hip pocket 108 and/or the left hip pocket 110 may each include a main pocket 128, which will be described in more detail below, for example, with respect to the detailed description of FIGS. 5, 6, 7A, 7B, 7C, and 7D.

Certain types of conventional travel luggage including backpacks have more than one carrying mechanism. For example, a student backpack may be carried aboard a vehicle such as an airliner as a personal item and may have both shoulder straps and a handle. Likewise, a wheeled carry-on suitcase may have handles on the side and top for carrying the suitcase in one hand without using wheels. However, such carrying mechanisms do not typically change the efficiency of accessing items within the luggage during travel. The convertible hip belt 102, in various example implementations, improves luggage technology by providing travel luggage with multiple modes of usage and advantages not found in conventional hip belts for hiking or camping.

In a backpack mode 104, the convertible hip belt 102 not only supports at least a portion of the load within the backpack but also provides features and advantages that may not be found on existing backpack hip belts. For example, some existing backpack hip belts include a small pocket. Such backpack hip belts may be tightly cinched in order to effectively support the load being carried. However, tightly cinching an existing hip belt may make it difficult to carry or access certain types of items while the hip belt is cinched. As will be described in more detail below, the convertible hip belt 102 improves travel efficiency by enabling a wider range of items to be usefully carried and easily accessed during travel.

Figure 2:
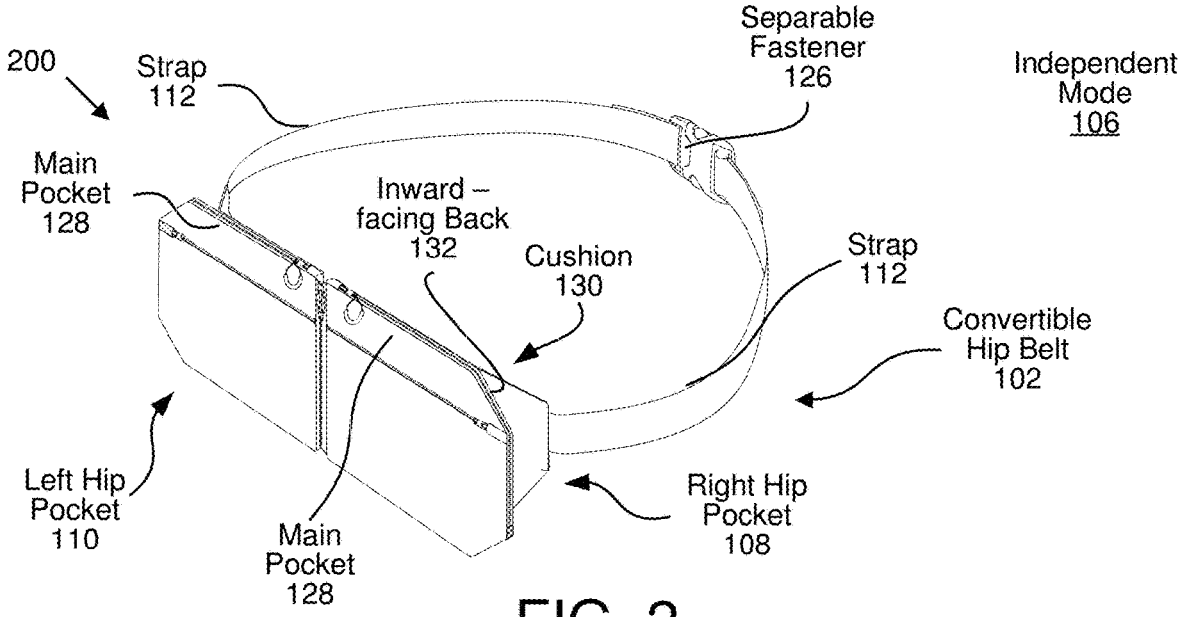
FIG. 2 is a perspective view of the convertible hip belt configured in an independent mode, according to one or more examples of the present disclosure.

FIG. 2 is a perspective view of one example implementation of an apparatus 200 that includes the convertible hip belt 102 configured in an independent mode 106, according to one or more examples of the present disclosure. To switch the configuration of the convertible hip belt 102 from the backpack mode 104 to the independent mode 106, a user may easily decouple the left hip pocket 110 and the right hip pocket 108 from the backpack 124. Unlike existing systems, such decoupling can be readily performed while the user is wearing the backpack 124. With the convertible hip belt 102 decoupled from the backpack 124, the user couples the left hip pocket 110 to the right hip pocket 108, so as to configure a new independent mode, such as, for example, a sling bag mode. More details about the various modes that may be configured with the convertible hip belt 102 in the independent mode 106 are provided below, such as described below with respect to FIGS. 8A-8F. Other example implementations of various modes and advantages provided by such modes are found in various portions of the present disclosure.

Figure 3:
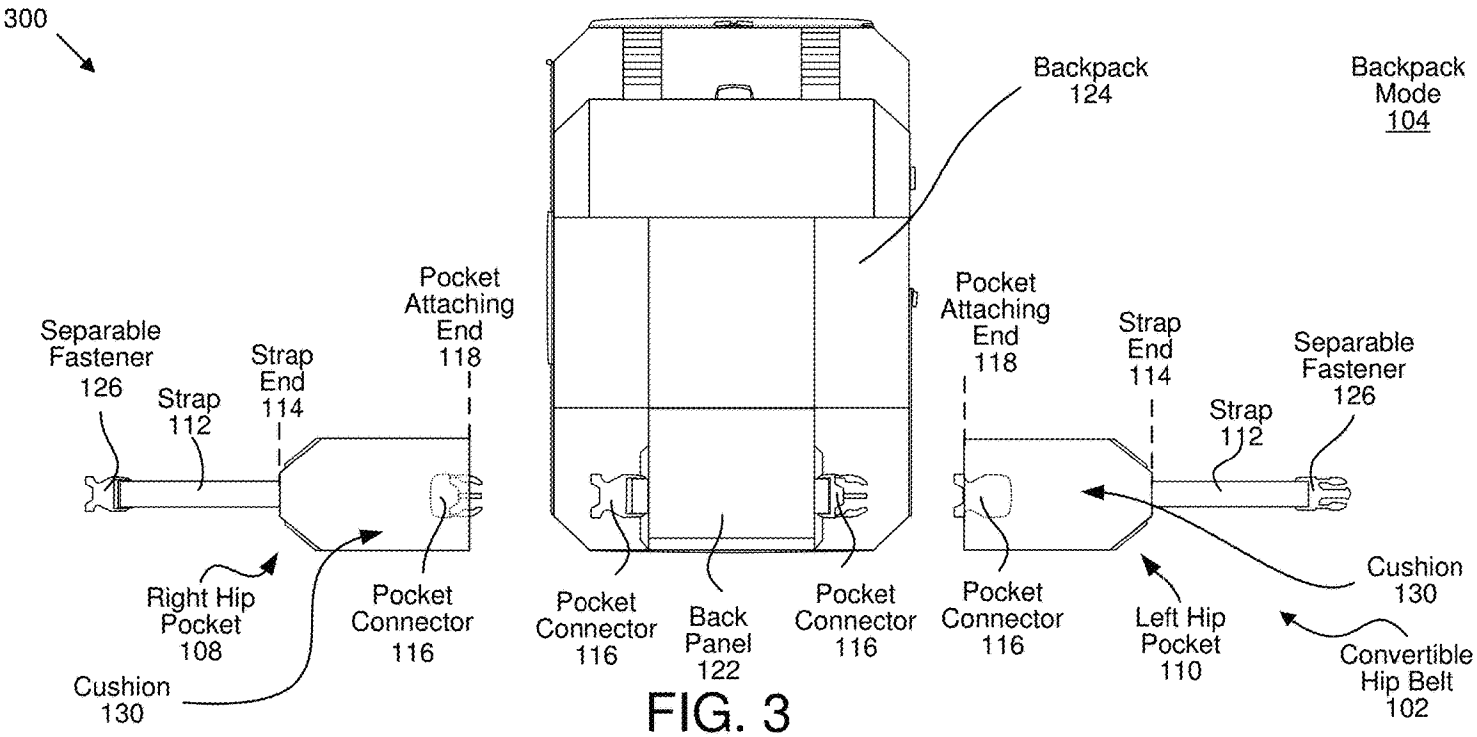
FIG. 3 is a rear view of the convertible hip belt with pocket connectors of the hip pockets decoupled from complementary fasteners on a backpack, according to one or more examples of the present disclosure.

FIG. 3 is a rear view of an example implementation of an apparatus 300 that includes an instance of the convertible hip belt 102. In the example illustration, the pocket connectors 116 of the right and left hip pockets 108, 110 are decoupled from the complementary pocket connectors 116 on the backpack 124, according to one or more examples of the present disclosure. In one example implementation, as depicted in FIG. 3, the right hip pocket 108 includes a pocket connector 116 that is complementary to a pocket connector 116 of the left hip pocket 110.

In certain example implementations, the separable fastener 126 and/or the one or more pocket connectors 116 include a side release buckle that may be decoupled from a complementary side release buckle that is on the back panel 122 of the backpack 124 by squeezing the side release buckle with one hand. In some example implementations, other types of complementary separable fasteners 126 and/or pocket connectors 116 may be used, such as, for example, hook-and-loop fasteners, zippers, snaps, and so forth. In one embodiment, the separable fasteners 126 and/or the one or more pocket connectors 116, include a buckle-type connector that engages magnetically by pushing complementary connectors towards each other and disengages by sliding complementary connectors in opposite directions perpendicular to the strap 112. One example of such a buckle-type connector is a 40 mm slider buckle available from Fidlock GmbH of Hannover, Germany.

One benefit of including pocket connectors 116 that are buckle-type connectors is that buckle-type connectors can be easily and quickly coupled and decoupled in the backpack mode 104 while wearing the backpack 124 by the user reaching behind her back and squeezing the coupled pocket connectors 116 to decouple the convertible hip belt 102 and similarly coupling the complementary pocket connectors 116 together by pushing the pocket connectors 116 on the hip pockets 108, 110 towards the pocket connectors 116 on the back panel 122.

Figure 4:
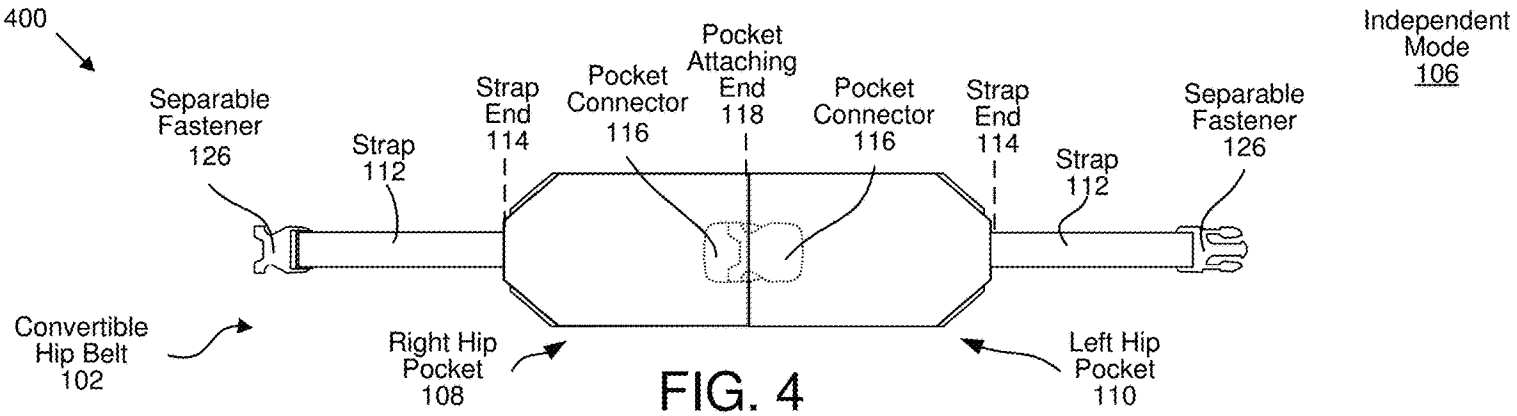
FIG. 4 is a rear view of the convertible hip belt in an independent mode with the pocket connectors of the left and right hip pockets coupled together, according to one or more example implementations of the present disclosure.

FIG. 4 is a rear view of an apparatus 400 that includes an instance of the convertible hip belt 102 in an independent mode 106 with the pocket connectors of the left and right hip pockets 110, 108 coupled together, according to one or more example implementations of the present disclosure. In one example implementation, the one or more pocket connectors 116 of the convertible hip belt 102 may be attached to the pocket-attaching end 118 of the cushion 130 that is attached to an inward-facing back 132 of the main pocket 128.

Figure 5:
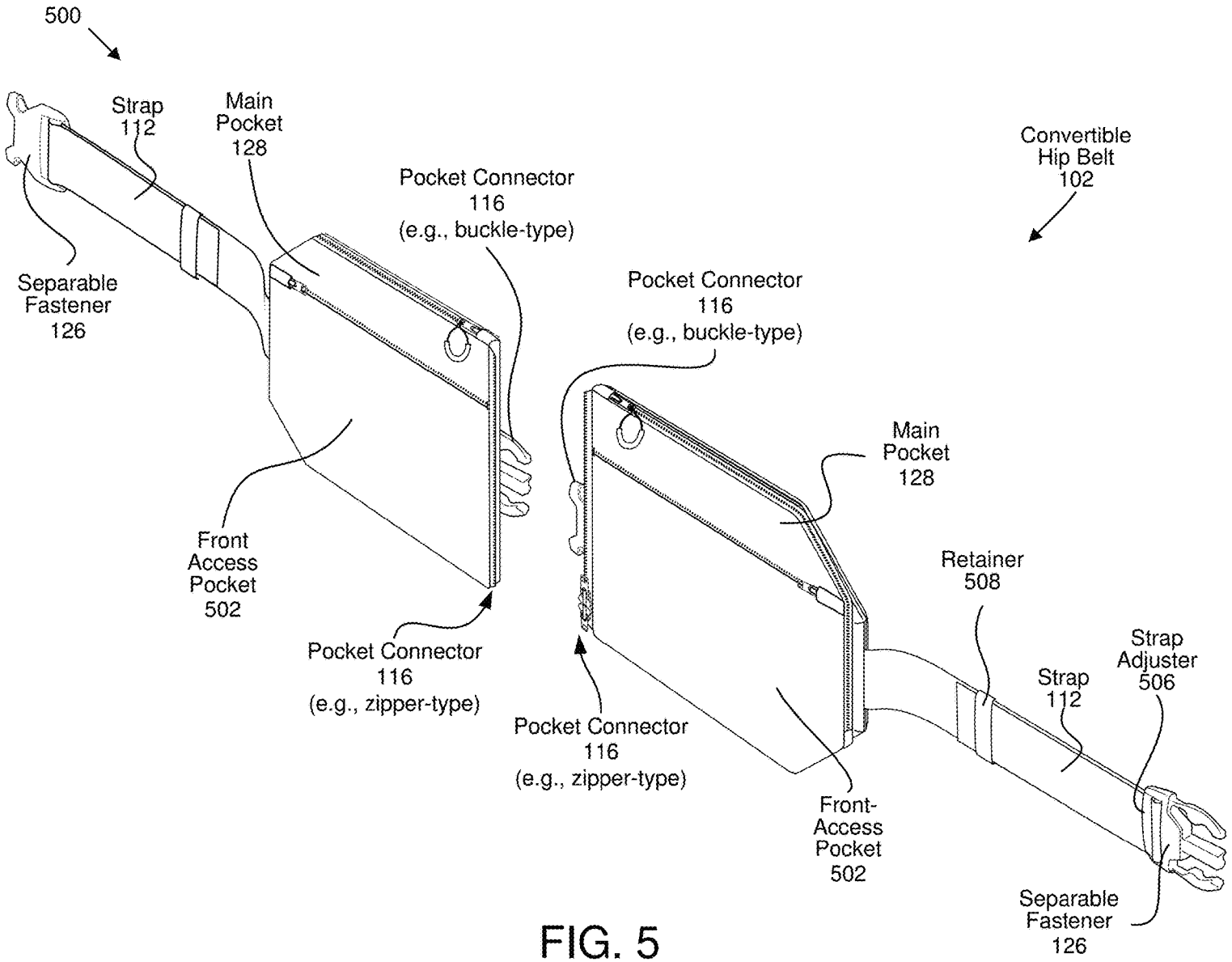
FIG. 5 is a perspective view of the convertible hip belt with the pocket connectors of the hip pockets aligned for coupling together, according to one or more example implementations of the present disclosure.

FIG. 5 is a perspective view of an apparatus 500 that includes an instance of the convertible hip belt 102 in the independent mode with the pocket connectors 116 of the hip pockets 108, 110 aligned for coupling together, according to one or more example implementations of the present disclosure. As mentioned above, although various types of non-buckle-type separable fasteners 126 and/or pocket connectors 116 have complementary halves and may be used in accordance with one or more examples of the present disclosure, buckle-type fasteners and/or connectors may include strap adjusters 506 that facilitate quick and efficient adjustments of strap lengths for configuring the convertible hip belt 102 into various backpack modes 104 and independent modes 106 that improve travel efficiency.

In some example implementations, the one or more pocket connectors 116 include pocket connectors 116 that are buckle-type connectors attached to an inward-facing back 132 of the left and right hip pockets 110, 108, such as the cushion 130. As mentioned above, pocket connectors 116 that are buckle-type connectors allow the left and right hip pockets 110, 108 to easily couple and decouple with each other and to likewise easily couple and decouple with complementary separable fasteners 126 at the end of the straps 112.

The one or more pocket connectors 116 also include, in certain example implementations, a second pair of pocket connectors 116 that are zipper-type connectors. In such example implementations, the pocket connectors 116 that are zipper-type enable the main pockets 128 of the right and left hip pockets 108, 110, to couple together in the independent mode 106, to form a useful piece of easily accessible luggage such as, for example, a sling bag for efficient carrying and access of various items that are useful during travel and/or for short excursions after reaching an initial travel destination. Additional examples illustrating different modes that utilize pocket connectors 116 that are zipper-type connectors are described in more detail below with respect to FIGS. 6, 7A, 7B, 7C, 7D, 8A, 8B, 8C, 8D, and 9.

In various example implementations, the right hip pocket 108 and/or the left hip pocket 110 individually include a front-access pocket 502 on an outward-facing portion of a main pocket 128. Additional details about the main pocket 128 are described below, for example, with respect to FIG. 6.

In some example implementations, the straps 112 of the convertible hip belt 102 include strap adjusters 506 and retainers 508 for adjusting an effective length of the straps 112 in various configurations of the independent mode 106 and/or in the backpack mode 104.

Figure 6:
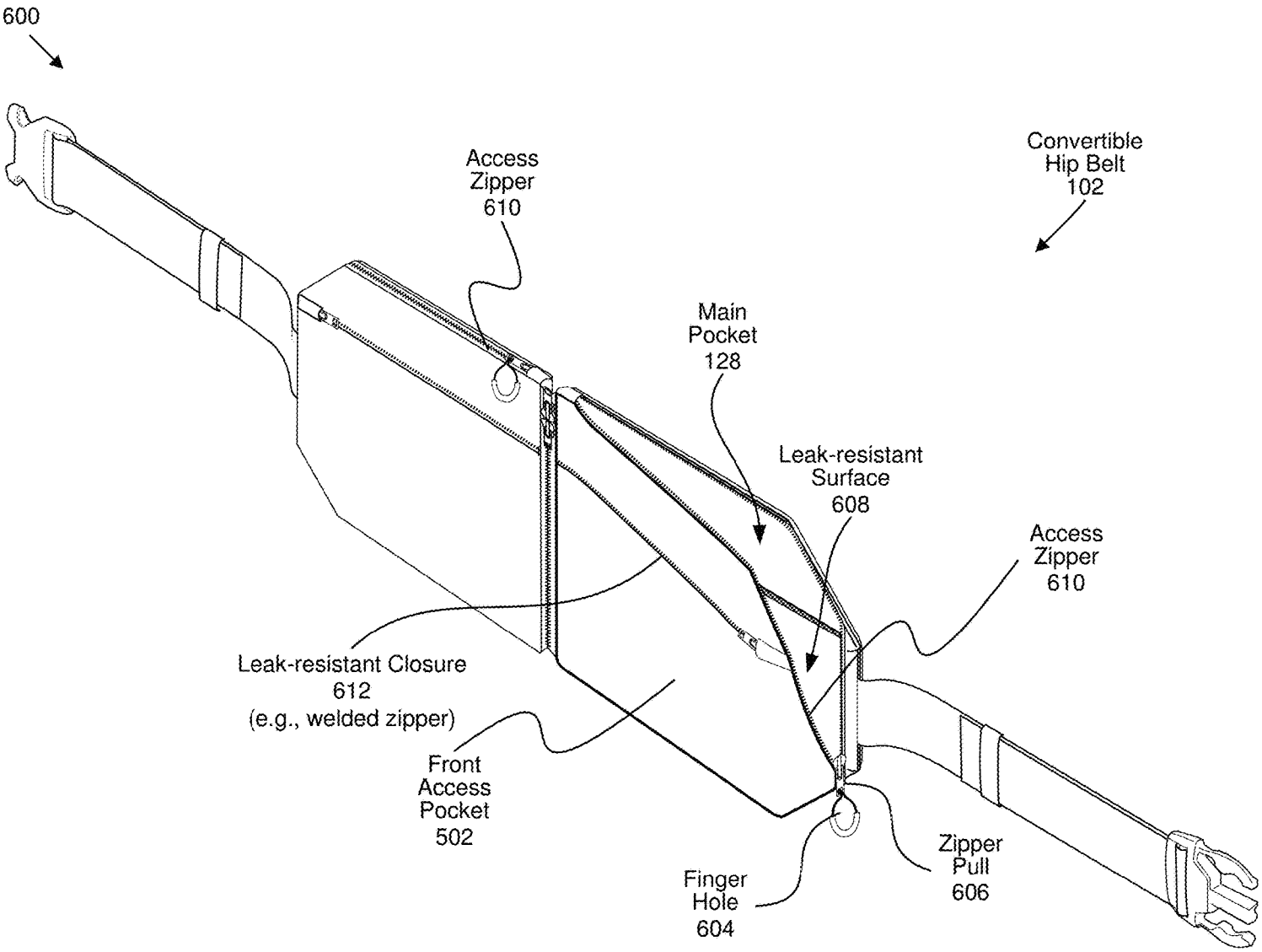
FIG. 6 is a perspective view of the convertible hip belt with a main pocket unzipped to a fully open position and a front-access pocket that is zipped to a fully closed position, according to one or more example implementations of the present disclosure.

FIG. 6 is a perspective view of an apparatus 600 that includes an instance of the convertible hip belt 102. The convertible hip belt 102 is depicted with the main pocket 128 of the right hip pocket 108 having an access zipper 610 that is unzipped to a fully open position and with the front-access pocket 502 zipped to a fully closed position, according to one or more example implementations of the present disclosure.

In certain example implementations, the access zipper 610 of the main pocket 128 includes a zipper pull 606 with a finger hole 604 sized to allow a fingertip to pass through. Existing zipper pulls on suitcases or backpacks, which are typically zipped or unzipped while not being utilized and/or worn by a user, do not have such a finger hole. Various example implementations of the convertible hip belt 102 include the finger hole 604 to facilitate easy zipping and unzipping while the convertible hip belt 102 is being used in the backpack mode 104 and/or the independent mode 106, even in situations where a user cannot see the zipper pull 606, such as, for example, when standing in line at an airport gate or within an airliner. For example, an item such as a wallet with an ID card can be carried in the main pocket 128 with the access zipper 610 zipped up until the moment it is needed at which point the user can unzip the main pocket 128 using the finger hole 604. After the item has been used, it can be placed again into the main pocket 128 and the access zipper 610 can be securely and easily zipped closed.

In some example implementations, the main pocket 128 and/or the front-access pocket 502 includes a leak-resistant surface 608 (e.g., interior and/or exterior) and/or a leak-resistant closure 612. In existing backpack hip belts with single pockets, spillage of a liquid within the single pocket can damage important items such as electronic items like smartphones or documents such as passports, notes, reservations, tickets, etc. The leak-resistant interior surface 608 of the main pocket 128 and/or the front-access pocket 502 can be used to separate items containing liquid in either the main pocket 128 or the front-access pocket 502 from items in the other pocket that could be damaged by leakage. In certain example implementations, the leak-resistant closure 612 includes a welded zipper (as shown in FIG. 7D). Other types of leak-resistant closures, such as, for example, press-together or slider zip locking seals may be used in accordance with one or more examples of the present disclosure.

Figure 7A:
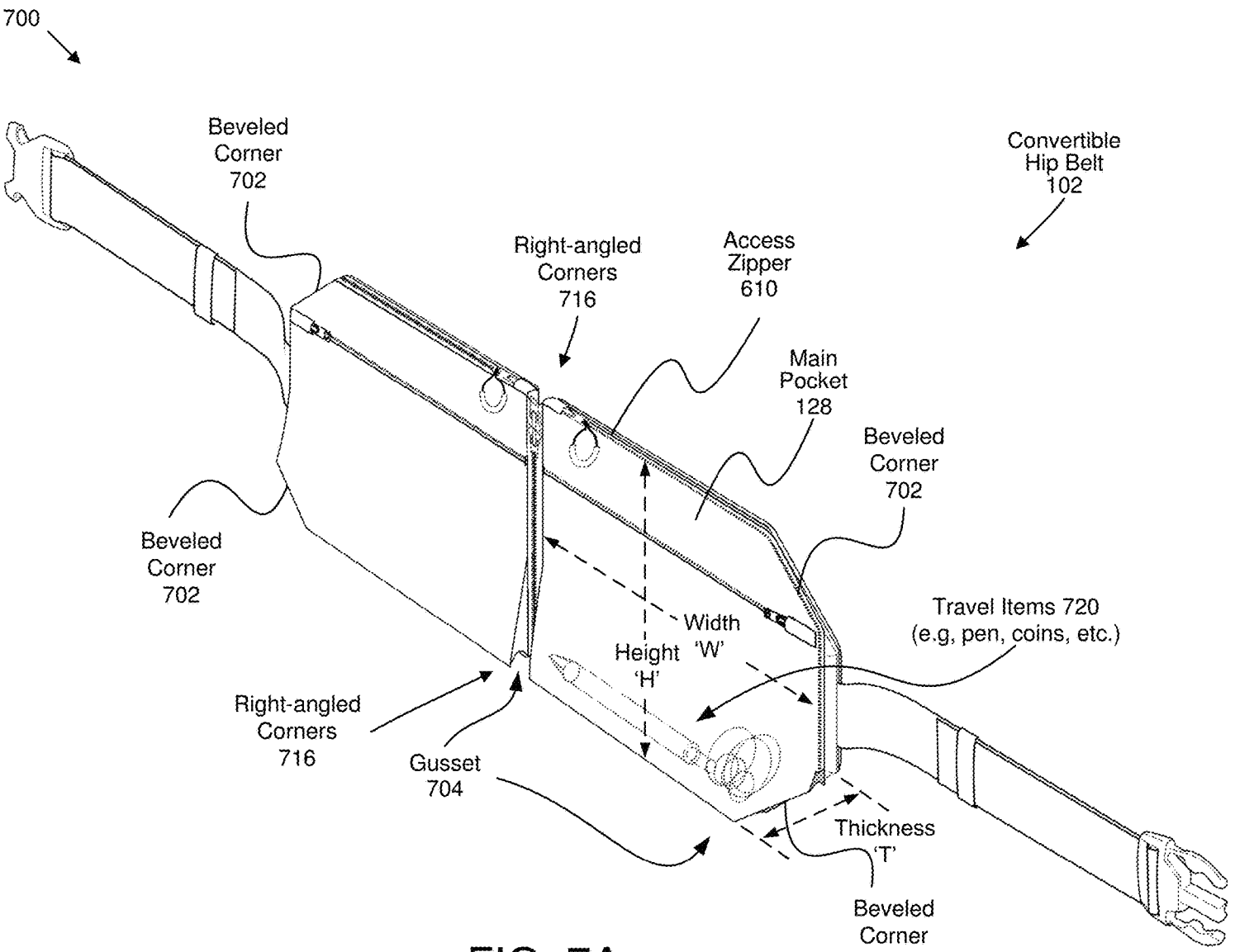
FIG. 7A is a perspective view of a convertible hip belt with the hip pockets coupled together and includes a large main pocket with a gusset, according to one or more example implementations of the present disclosure.

FIG. 7A is a perspective view of an apparatus 700 that includes an instance of the convertible hip belt 102 with the right and left hip pockets 108, 110 coupled together. The convertible hip belt 102 includes a large main pocket 128 with a gusset 704, according to one or more example implementations of the present disclosure. Hip pockets in existing backpacks are often used only incidentally and are therefore inefficient for easily accessing items useful during mixed-mode travel. For example, some hip pockets for existing backpacks include a zipper only at the top, which makes it harder to reach down and pull out and/or replace items useful during travel while wearing the backpack.

In certain example implementations, the convertible hip belt 102 of the apparatus of 700 has a semi-rectangular form that includes one or more right-angled corners 716 at the pocket-attaching end 118 (shown in FIGS. 3, 4). In such example implementations, the convertible hip belt 102 also includes one or more beveled corners 702 at the strap end 114 (shown in FIGS. 3, 4) of the right and left hip pockets 108, 110. In various example implementations, the access zipper 610 of the main pocket 128 extends from the right-angled corners 716 at the top of the pocket-attaching end 118 along a top edge and along a side edge at the strap end 114 to terminate at a top point of the beveled corner 702 at the bottom of the strap end 114, such that the beveled corner 702 is configured to prevent items in a bottom portion of the main pocket 128 from sliding out an outer side of the main pocket 128. Such items may include items that slide easily such as a pen, coins, and so forth. This anti-spill pocket shape is quite beneficial for modes in which the convertible hip belt 102 is worn at a non-horizontal angle.

The convertible hip belt 102 of the apparatus 700 includes, in various example implementations, a gusset 704 that is configured to expand and/or compress based on a total size of travel items 720 stored within the main pocket 128. Without a gusset, existing hip pockets for backpacks do not expand or compress efficiently, the lack of expansion capabilities reduces the flexibility of such existing hip pockets to accommodate multiple items useful during travel, and in particular, to accommodate several relatively large items. In example implementations, the main pocket 128 has a minimum width of about 6 inches, a minimum height of about 4 inches, and an expandable thickness of from about 0.1 inch to about 3 inches.

Various designers of hip belts for existing backpacks, such as, for example, hiking or camping backpacks, have not included large hip pockets. Such existing backpacks typically have many side pockets and other compartments and therefore designers have had little motivation to select large hip pockets. Furthermore, where existing hip belts have no pockets, small pockets, or even a single pocket, such pockets may not be suitable for carrying certain types of items such as, for example, valuable yet somewhat sensitive items such as a smartphone with a 6 inch or larger display screen.

Beneficially, the convertible hip belt 102, in various example implementations, is configured to carry a significant number of items, including some large and potentially fragile items, that are useful during travel such as passports, smartphones, tablets, and so forth.

Figure 7B:
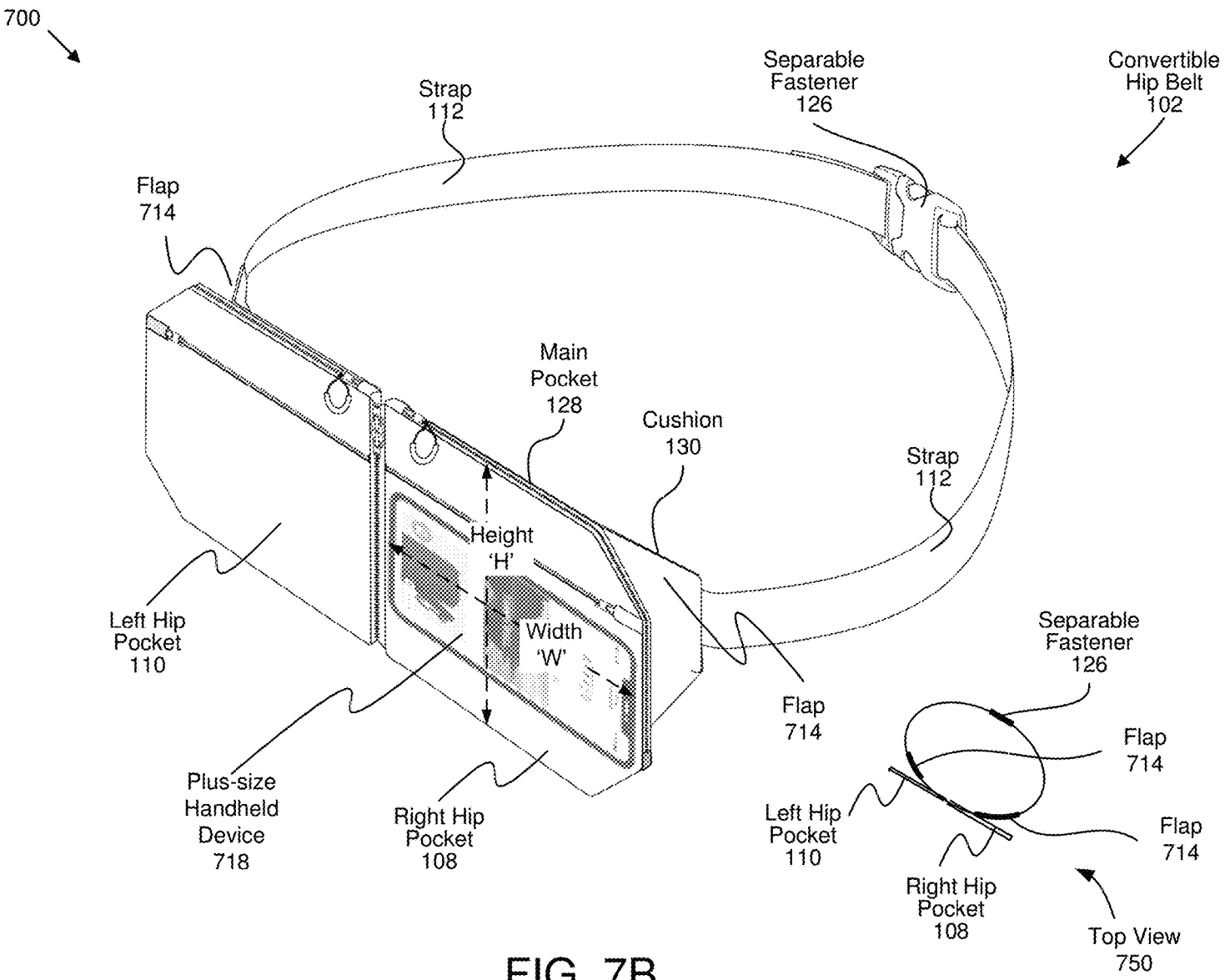
FIG. 7B is a perspective view of a convertible hip belt with the main pocket and a cushion with a flap at the strap end to reduce a risk of subjecting objects in the main pocket to a damaging bending force, according to one or more example implementations of the present disclosure.

FIG. 7B is a perspective view of an apparatus 700 that includes an instance of the convertible hip belt 102. The convertible hip belt 102 includes a main pocket 128 and a cushion 130 with a flap 714 at the strap end 114 (shown in FIGS. 3, 4) configured to enable the strap 112 (shown in FIGS. 1, 2, 3, and 4) to be tightly coupled and to reduce a risk of subjecting objects in the main pocket 128 to a damaging bending force, according to one or more example implementations of the present disclosure. When the convertible hip belt 102 depicted in the apparatus 700 is in the independent mode and the straps 112 are coupled tightly around the user's waist in order to support a portion of the load within a backpack 124, a bending force is exerted on the strap ends 114 of the right and left hip pockets 108, 110.

However, because in various example implementations, the strap 112 is attached to a flap 714 at the strap end 114 of the right and left hip pockets 108, 110, the flap 714 is bent to curve around the user's waist and the plus-size handheld device 718 is not subjected to the bending force because the strap end 114 of the right and left hip pockets 108, 110 is free to remain straight while the flaps 714 are bent by the tightening straps 112. The top view 750 of the convertible hip belt 102 pictorially illustrates how the bendable feature of the flaps 714 protects items in the right and left hip pockets 108, 110.

In the backpack mode 104 as well, the bendable nature of the flaps 714 being separate at the strap end 114 from the main pocket 128 provides a similar benefit even though the pocket connectors 116 at the pocket-attaching ends 118 are coupled to the complementary pocket connectors 116 of the back panel 122 on the backpack 124 rather than to each other. At the same time, the bending of the flaps 714 helps maximize the ability of the convertible hip belt 102 to support a portion of the weight of a load in the backpack 124. In any mode, the bendable flaps 714 can make the convertible hip belt 102 more comfortable to use.

Figure 7C:
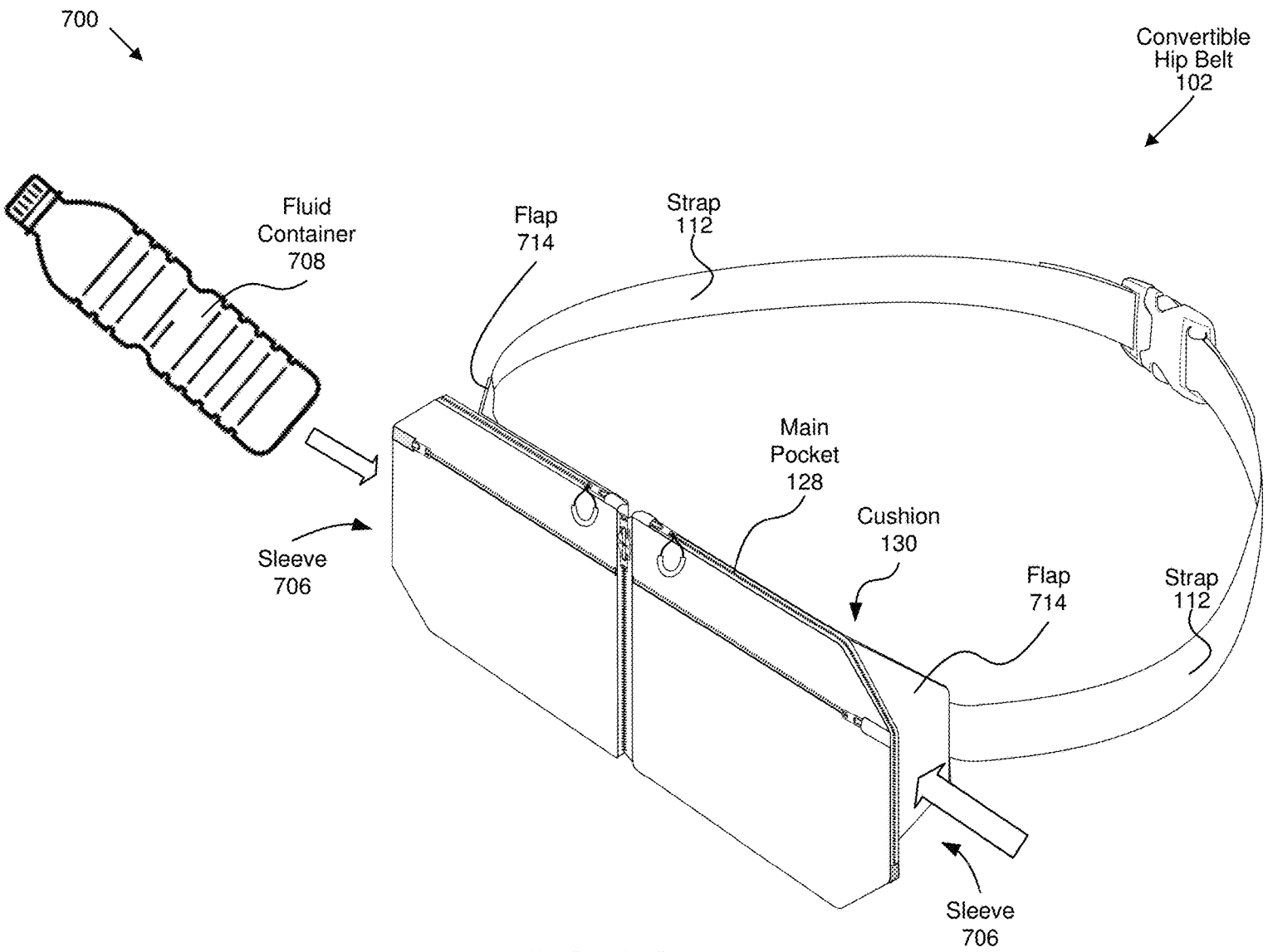
FIG. 7C is a perspective view of a convertible hip belt for efficient travel having a sleeve configured to hold objects between the main pocket and a cushion of each hip pocket, according to one or more example implementations of the present disclosure.
Figure 7D:
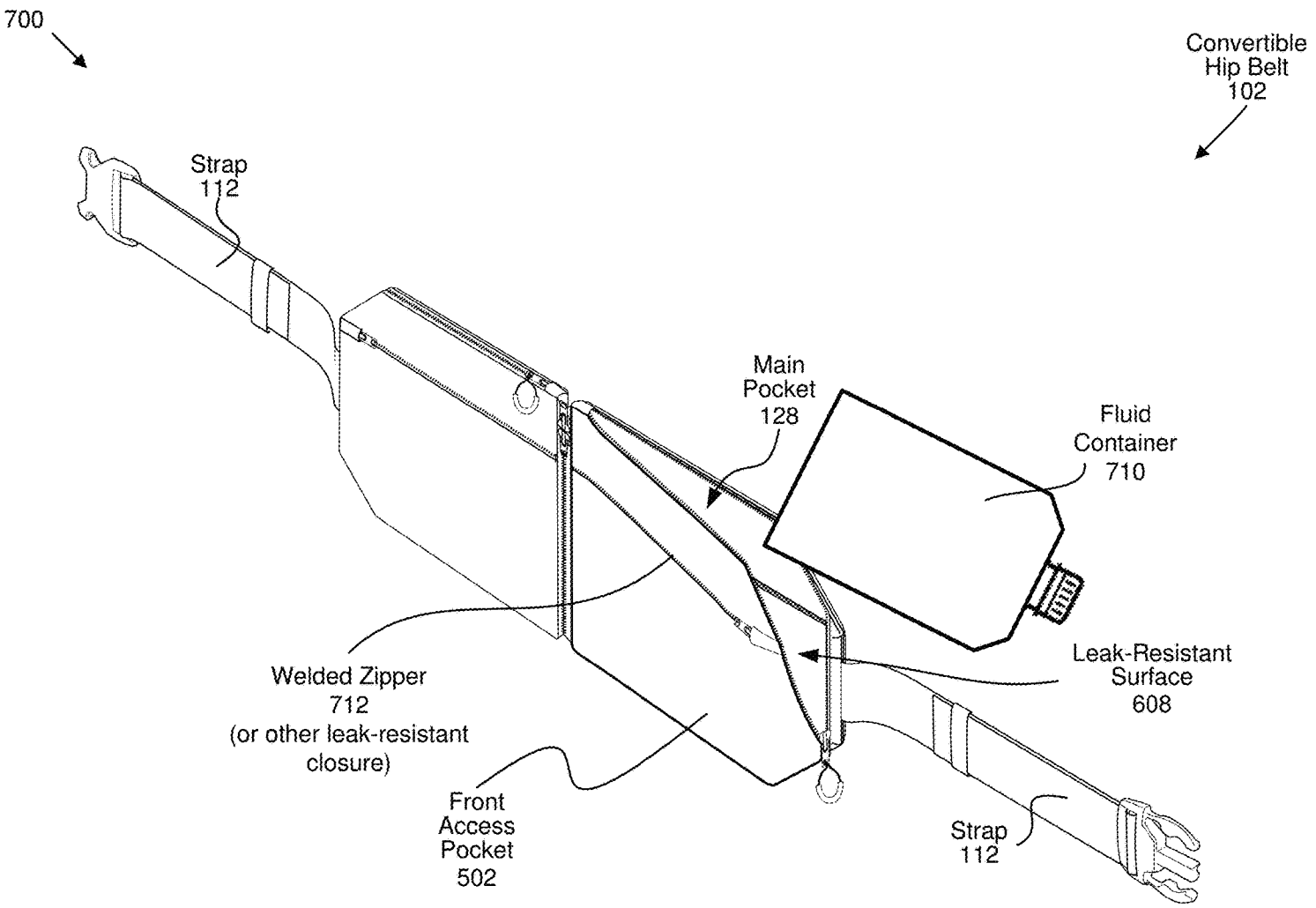
FIG. 7D is a perspective view of a convertible hip belt with a leak-resistant main pocket and/or a front-access pocket which may include a welded zipper, according to one or more example implementations of the present disclosure.

FIG. 7C is a perspective view of the apparatus 700 which includes a convertible hip belt 102. They convertible hip belt 102 has a sleeve 706 configured to hold objects between the main pocket 128 and a cushion 130 of each hip pocket 108, 110, according to one or more example implementations of the present disclosure. The sleeve 706 is formed by attaching the cushion 130 to the main pocket 128 at the top and bottom edges while leaving an opening between such edges. The flexibility of the cushion 130 allows items such as the fluid container 708 to be inserted into the sleeve 706. Other items, such as, for example, boarding passes, tickets, and so forth, may be temporarily inserted into the sleeve 706 for rapid retrieval of such items without zipping or unzipping of pocket closures.

In some example implementations, the sleeve 706 extends from the strap end 114 of the right hip pocket 108 through to the strap end 114 of the left hip pocket 110. As described above with respect to FIG. 6, the main pocket 128 of the convertible hip belt 102 includes, in certain example implementations, a leak-resistant interior surface 608 that protects items within the main pocket 128 from condensate or leaking fluids within the sleeve 706.

FIG. 7D is a perspective view of the apparatus 700 which includes a convertible hip belt 102 and has a leak-resistant main pocket 128 and/or a leak-resistant front-access pocket 502, according to one or more example implementations of the present disclosure. In some example implementations, the leak resistant main pocket 128 and/or the leak resistant front access pocket 502 may include a welded zipper 712 which further enhances the leak resistance as compared with a sewn-on zipper. In certain example implementations, the fluid container 710 is sized and shaped to fit entirely within the main pocket 128, whether the main pocket 128 is zipped or unzipped. Such implementations provide a convenient and efficient way to carry fluids within the convertible hip belt 102 when using it in the independent mode 106.

In the independent mode 106, one or more of the straps 112 of the convertible hip belt 102 are adjustable in length to facilitate wearing the convertible hip belt 102 in a plurality of modes comprising an elbowed sling bag mode, a front-facing sling bag mode, a back-facing sling bag mode, a fanny pack mode, a purse mode, and a hand-tote mode.

Various such modes are illustrated in the example implementations depicted in FIGS. 8A through 8F.

Figure 8A:
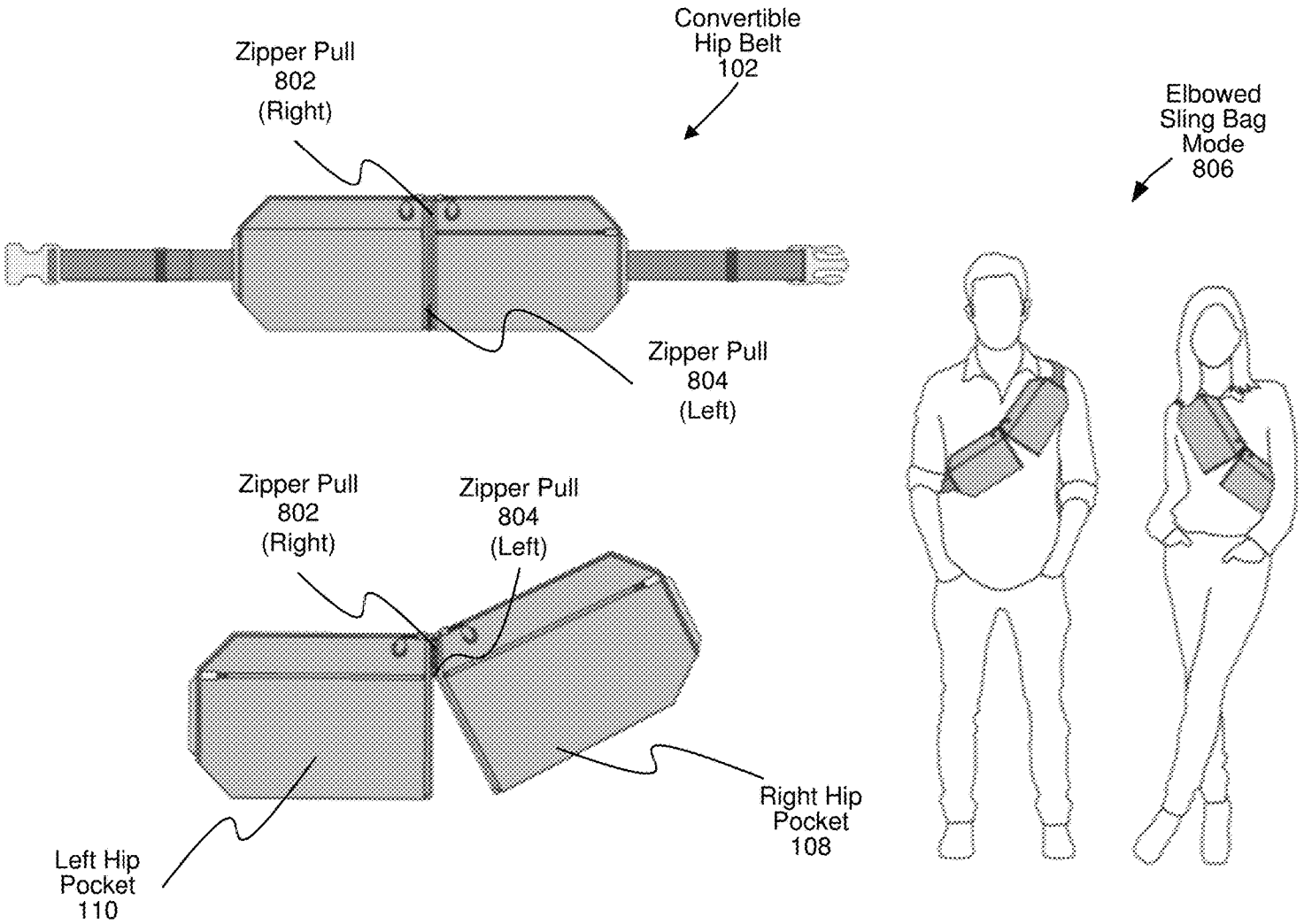
FIG. 8A is a front view of a convertible hip belt configured in an elbowed sling bag mode, according to one or more example implementations of the present disclosure.

FIG. 8A is a front view of the convertible hip belt 102 configured in an elbowed sling bag mode 806, according to one or more example implementations of the present disclosure. In the elbowed sling bag mode 806, respective zipper pulls 802, 804 of the zipper-type connectors of the right hip pocket 108 and the left hip pocket 110 are slid to a top position of the convertible hip belt 102 such that right and left hip pockets 108, 110 hang from a shoulder of the user to form an elbow shape by being partially decoupled at a bottom edge of the pocket-attaching end 118 as shown in FIG. 4. The elbowed sling bag mode 806 wraps more efficiently around the user's body, which may be more comfortable.

Figure 8C:
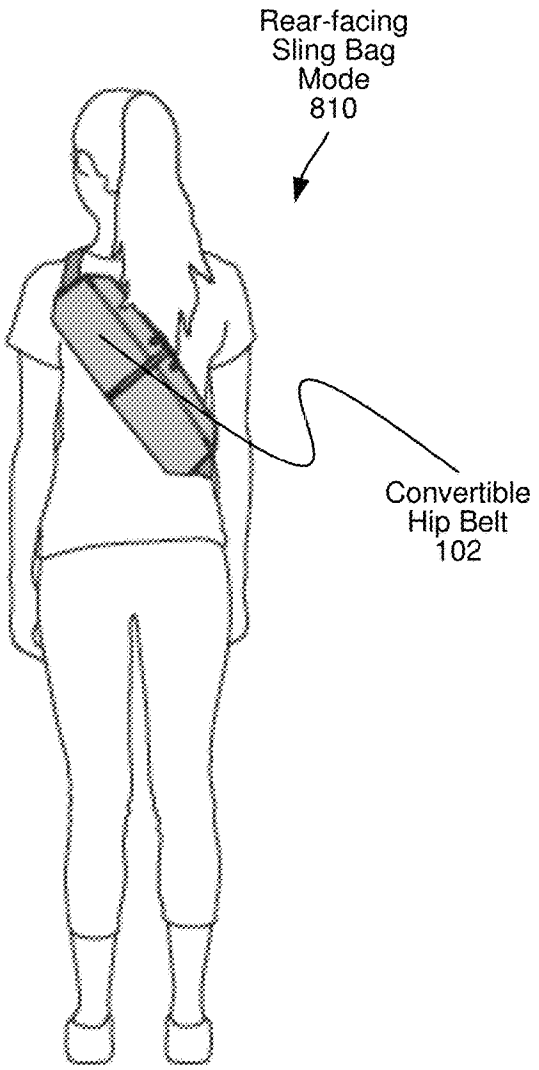
FIG. 8C is a front view of a convertible hip belt configured in a rear-facing sling bag mode, according to one or more example implementations of the present disclosure.
Figure 8B:
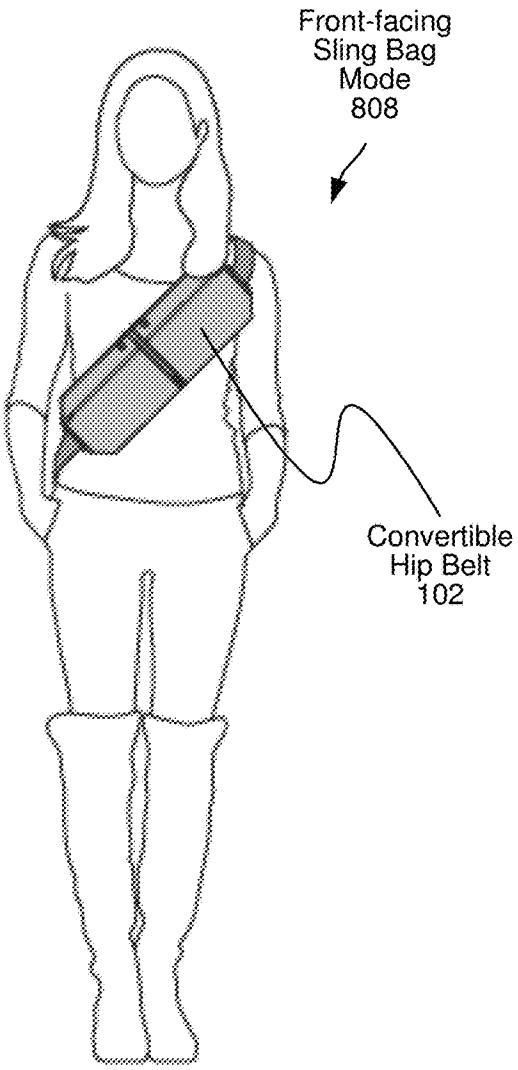
FIG. 8B is a front view of a convertible hip belt configured in a front-facing sling bag mode, according to one or more example implementations of the present disclosure.

FIG. 8B is a front view of the convertible hip belt 102 configured in a front-facing sling bag mode 808, according to one or more example implementations of the present disclosure.

FIG. 8C is a front view of the convertible hip belt 102 configured in a rear-facing sling bag mode 810, according to one or more example implementations of the present disclosure.

In any of the configurations depicted in FIGS. 8A, 8B, and 8C, the upper end of the convertible hip belt 102 as depicted is more readily accessible in example implementations in which the zippered closure of the main pocket extends to the top of the beveled bottom corner at the strap end. Likewise, a zippered closure on the lower pocket of the convertible hip belt 102 as depicted need not be unzipped all the way to the top end of the bottom beveled corner in order to minimize the risk of items sliding out while the lower pocket is unzipped. Even with the lower pocket fully unzipped, the beveled corner and a gusset of various example implementations both assist in preventing items from sliding out the side even when tilted at an angle.

Figure 8F:
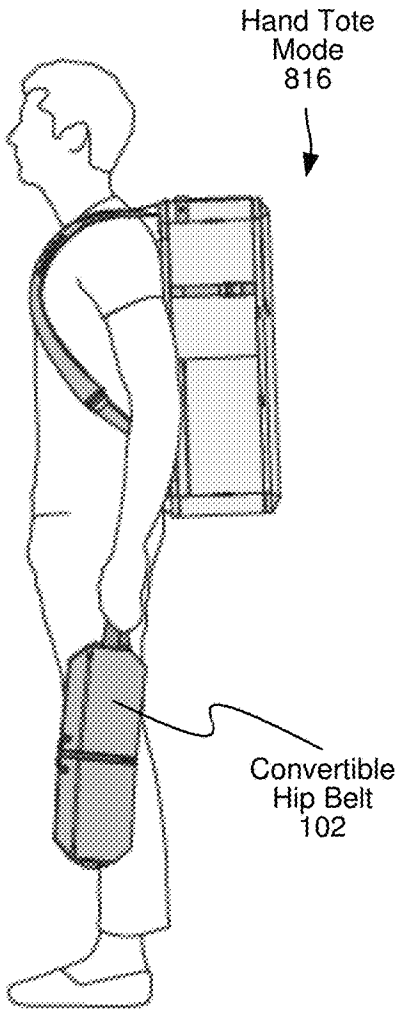
FIG. 8F is a front view of a convertible hip belt configured in a hand tote mode, according to one or more example implementations of the present disclosure.
Figure 8E:
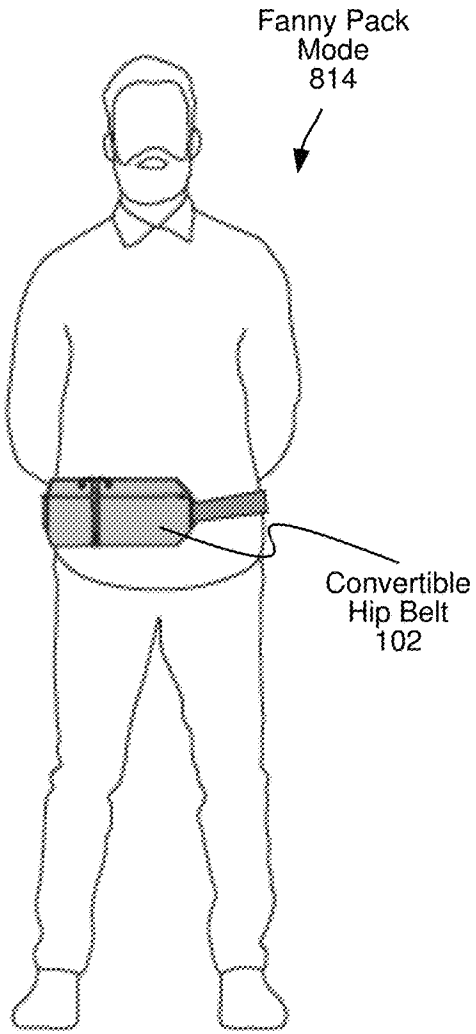
FIG. 8E is a front view of a convertible hip belt configured in a fanny-pack mode, according to one or more example implementations of the present disclosure.
Figure 8D:
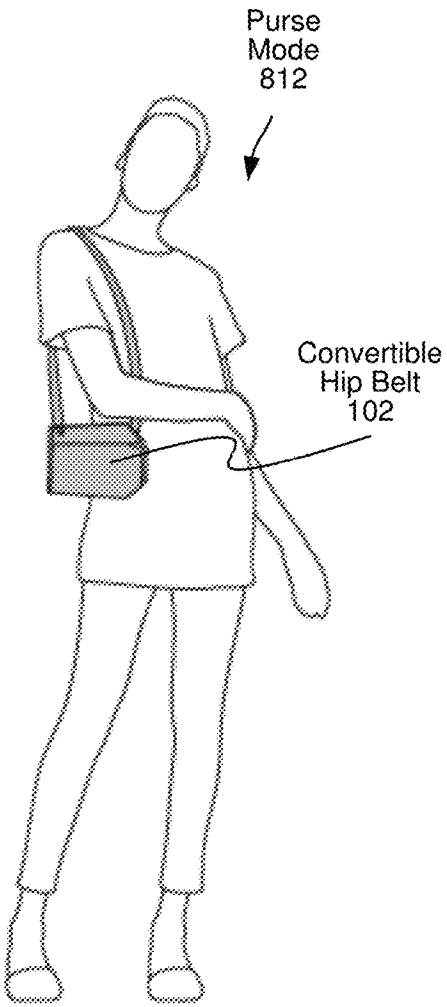
FIG. 8D is a front view of a convertible hip belt configured in a purse mode, according to one or more example implementations of the present disclosure.

FIG. 8D is a front view of the convertible hip belt 102 in a purse mode 812, according to one or more example implementations of the present disclosure. In the purse mode 812, and in other configurations, instead of the right hip pocket 108 and the left hip pocket 110 being coupled to each other at the pocket-attaching end 118, the pocket connector 116 at the pocket-attaching end 118 of either the right hip pocket 108 or the left hip pocket 110 may be coupled to a complementary fastener at the strap end 114 of the same hip pocket so as to form a single pocket sling bag and/or purse.

FIG. 8E is a front view of the convertible hip belt 102 in a fanny-pack mode 814, according to one or more example implementations of the present disclosure.

FIG. 8F is a front view of the convertible hip belt 102 in a hand tote mode 816, according to one or more example implementations of the present disclosure.

Figure 9:
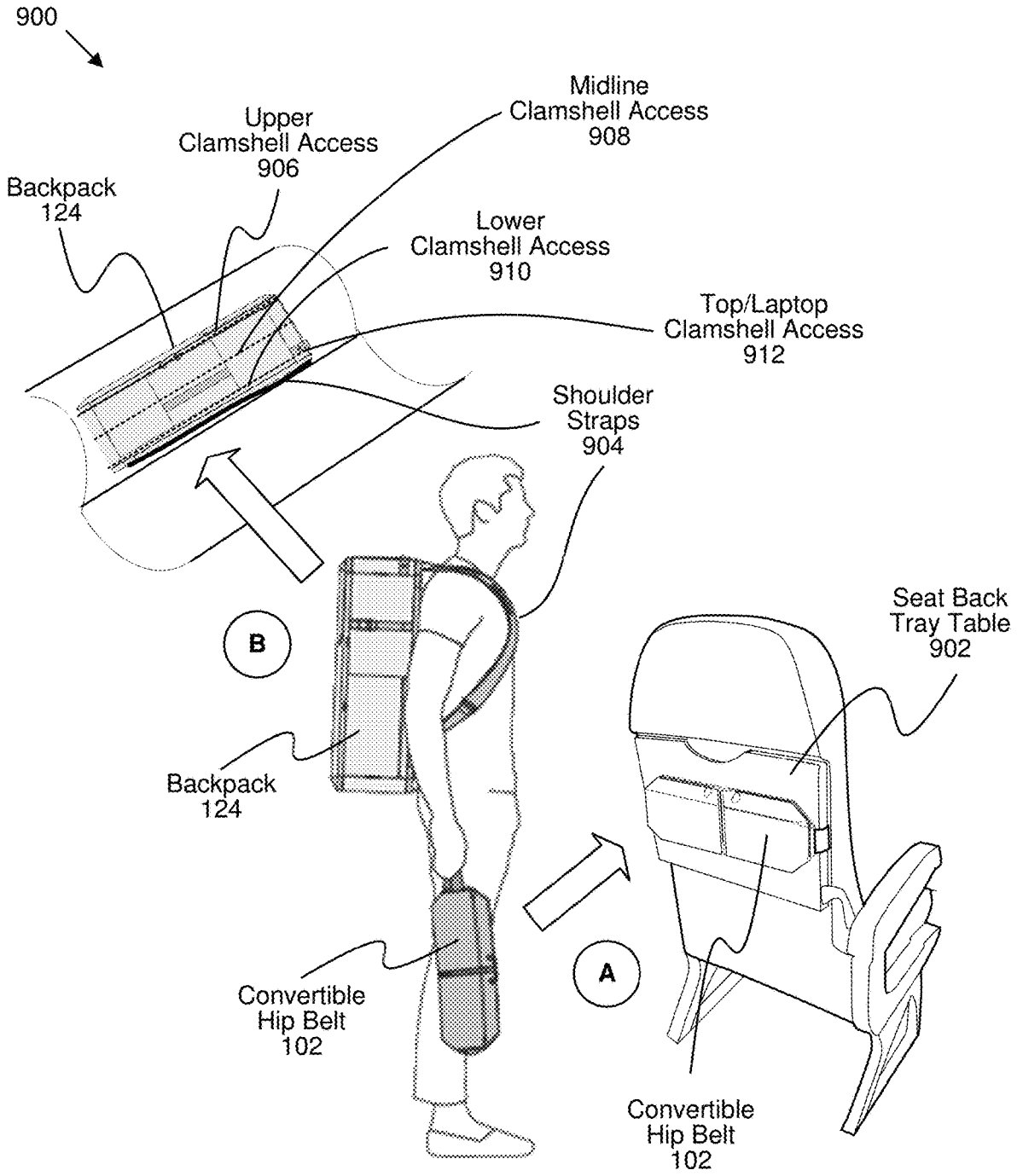
FIG. 9 is an illustration of a convertible hip belt and backpack system for efficient travel, according to one or more example implementations of the present disclosure.

FIG. 9 is an illustration of a system 900 that includes the convertible hip belt 102 and a carry-on backpack 124, according to one or more example implementations of the present disclosure. In one example implementation, the system 900 includes a carry-on backpack 124 having a main compartment with one or more clamshell accesses, e.g., 906, 908, 910, and 912 with corresponding zippered closures. The carry-on backpack 124 includes shoulder straps 904 and the system 900 includes the convertible hip belt 102, which has a right hip pocket and a left hip pocket that are detachably coupled to respective side portions of a lower back panel of the carry-on backpack 124.

In the illustrated example, when the user boards the airliner (or any other vehicle used for travel), the convertible hip belt 102 may still be in the backpack mode 104. Upon reaching his assigned seat, the depicted user may quickly and easily detach the convertible hip belt 102 from the carry-on backpack 124 while still wearing the carry-on backpack using the shoulder straps 904. The user may then connect the pocket connectors 116 (as best shown in FIGS. 3, 4) of the convertible hip belt 102 together, and tightly couple the convertible hip belt 102 around a seatback tray table 902 to provide ready and efficient access to items useful during travel which have been packed into the convertible hip belt 102. Such items may include, for example, an electronic device such as a smartphone, writing implements, money for purchasing onboard snacks or meals, a sudoku book, or various items that the user desires to access during travel.

In various example implementations, the side release buckles and the straps of the right and left hip pockets 108, 110 are sufficiently thin so as to allow the seatback tray table 902 to be closed and latched with the convertible hip belt 102 in independent mode strapped around the seatback tray table 902 to facilitate access to items in the right hip pocket 108 and/or the left hip pocket 110. It may be noted that the convertible hip belt 102 with its adjustable strap length may be configured to be strapped around car seats, bus seats, chairs, or a wide variety of items convenient and efficient for access during travel and/or at a temporary travel destination or other location. With the convertible hip belt 102 conveniently strapped around the seatback tray table 902, the user may now easily and efficiently stow the carry-on backpack 124 in a temporary storage compartment such as an overhead bin in an airliner.

In some example implementations, with the carry-on backpack 124 closed, the carry-on backpack 124 is configured to fit within a carry-on baggage sizer having interior dimensions of 22 inches wide by 16 inches high and 10 inches deep. In such example implementations, the shoulder straps 904 and/or the convertible hip belt 102 may be compressed against the body of the carry-on backpack 124 while still allowing the carry-on backpack 124 to fit within the carry-on baggage sizer. With the convertible hip belt 102 attached to the carry-on backpack 124, the system 900 may be considered to be a single item of carry-on luggage which may be more cost-efficient. Furthermore, because removing and storing both the decoupled convertible hip belt 102 and the carry-on backpack 124 is easier and faster than storing other items which are less appropriately sized, travel efficiency is increased both for the user who was wearing the carry-on backpack as well as for other travelers trying to move past the user.

As noted above, the term "clamshell access" refers to an enclosure (e.g., carry-on backpack) opening such as a zippered side or top of the enclosure which has two members pivotably connected at a hinging axis. For example, as depicted in FIG. 9, an upper clamshell access 906 may be unzipped at the outward-facing side of the carry-on backpack 124 and at the top and bottom edges of the backpack 124 so that the top portion of the carry-on backpack 124 pivots open at a hinging side edge opposite the outward-facing opening of the upper clamshell access 906. This configuration is beneficial for airline travel as it allows a user to access to items in an overhead compartment without removing the carry-on backpack 124 from the overhead compartment.

Other example implementations may include one or more additional clamshell accesses such as a midline clamshell access 908 or a lower clamshell access 910. Furthermore, a top clamshell access 912, also referred to as a "laptop clamshell access," is provided, in certain example implementations, at the top or upper end of the carry-on backpack 124. More details about such clamshell accesses are described below with respect to FIGS. 10A and 10B.

Figure 10A:
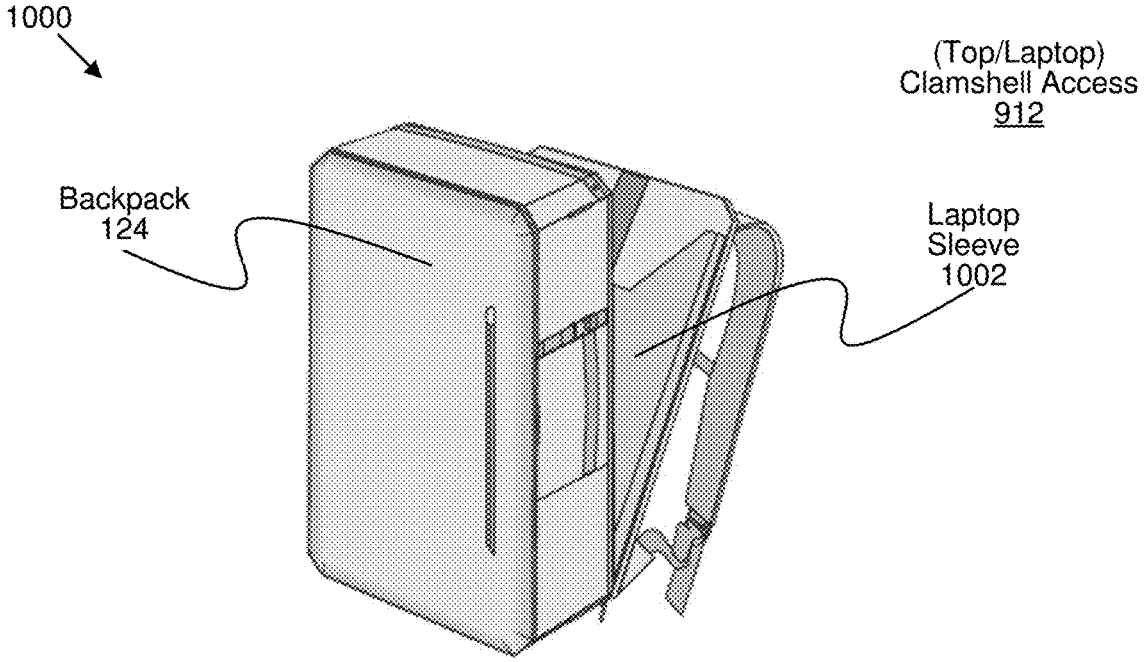
FIG. 10A is an illustration of a convertible hip belt and backpack system having a top clamshell access with a laptop sleeve, according to one or more example implementations of the present disclosure.

FIG. 10A is an illustration of a convertible hip belt and backpack system 1000 for efficient travel. The backpack 124 of the system 1000 includes a top clamshell access 912 with a laptop sleeve 1002, according to one or more example implementations of the present disclosure. Because the laptop sleeve 1002 is implemented with the top clamshell access 912 near to the shoulder straps 904 (as shown in FIG. 9), a laptop in the laptop sleeve 1002 is well protected by being positioned between a user's back and items stored within the backpack 124. At a security check, a laptop may be very efficiently retrieved from the laptop sleeve 1002 by opening a zipper of the top clamshell access 912. Although the convertible hip belt 102 is not depicted in FIG. 10A, it may be coupled to the backpack 124 substantially as described above with respect to FIGS. 1 and 3.

Figure 10B:
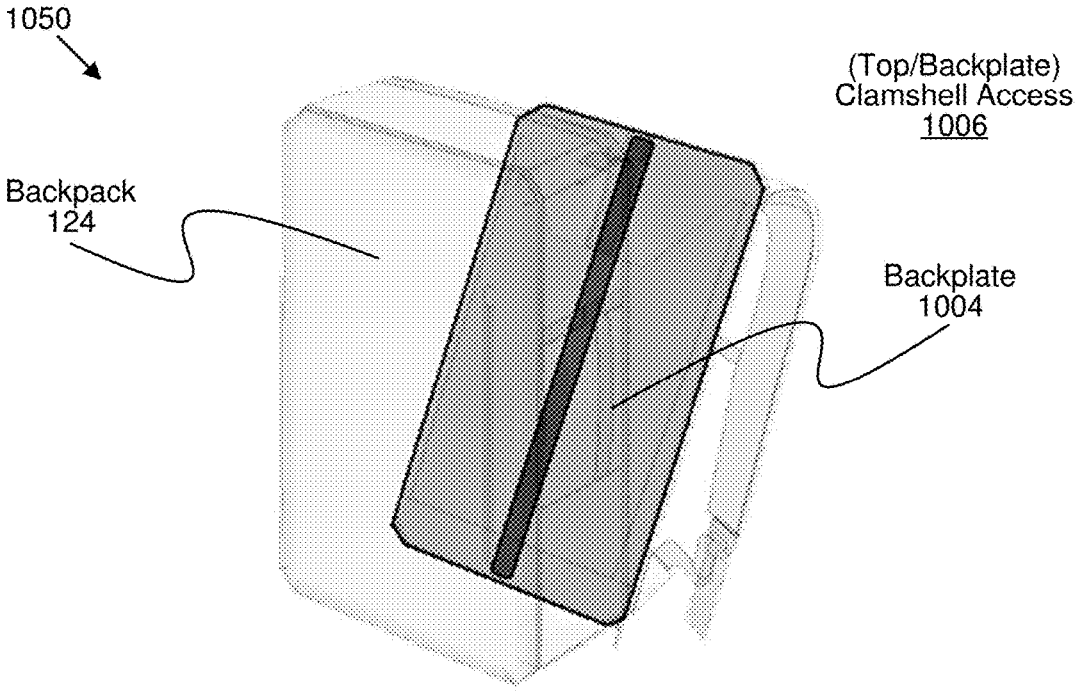
FIG. 10B is an illustration of a convertible hip belt and backpack system having a top clamshell access with a backplate, according to one or more example implementations of the present disclosure.

FIG. 10B is an illustration of system 1050 that includes a convertible hip belt (not shown) and a backpack 124. The backpack 124 includes a top clamshell access 1006 and a backplate 1004, according to one or more example implementations of the present disclosure. The backplate 1004, in various example implementations, is made of a flexible polymer sheet and a metal reinforcement strip extending along a middle portion of the sheet. The backplate 1004, in such embodiments, serves as a type of internal frame for the backpack 124 providing more rigid support as preferred by some users. The backplate 1004 may be inserted and/or removed using the clamshell access 1006 similarly to the top clamshell access 912 described above with respect to FIG. 10A.

Figure 11A:
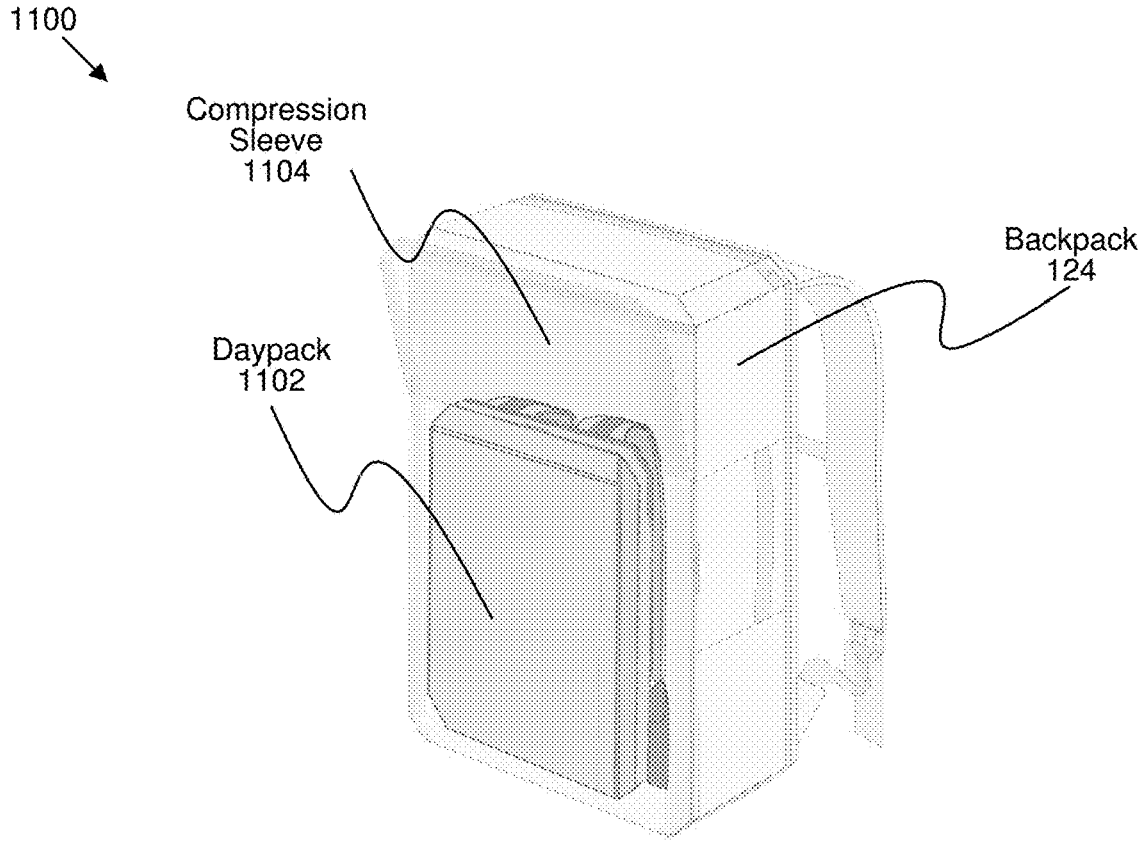
FIG. 11A is a perspective view of a convertible hip belt and backpack system for efficient travel having a compressible daypack and compression sleeve, according to one or more example implementations of the present disclosure.
Figure 11B:
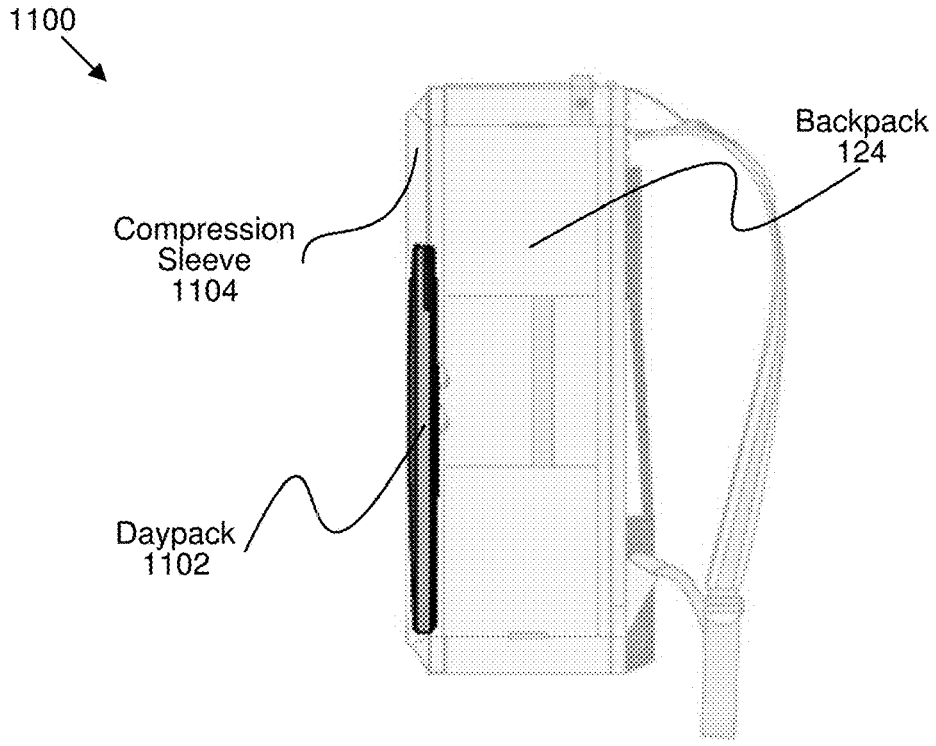
FIG. 11B is a side view of a convertible hip belt and backpack with a compressible daypack and a compression sleeve, according to one or more example implementations of the present disclosure.

FIG. 11A is a perspective view of a backpack system 1100 having a convertible hip belt (not shown). The system 1000 includes a daypack 1102 and a compression sleeve 1104 within the backpack 124, according to one or more example implementations of the present disclosure. FIG. 11B is a side view of the backpack system 1100. During travel, the empty daypack 1102 may be stowed in the compression sleeve 1104 while still allowing the backpack 124 to fit within the carry-on baggage sizer.

Figure 12A:
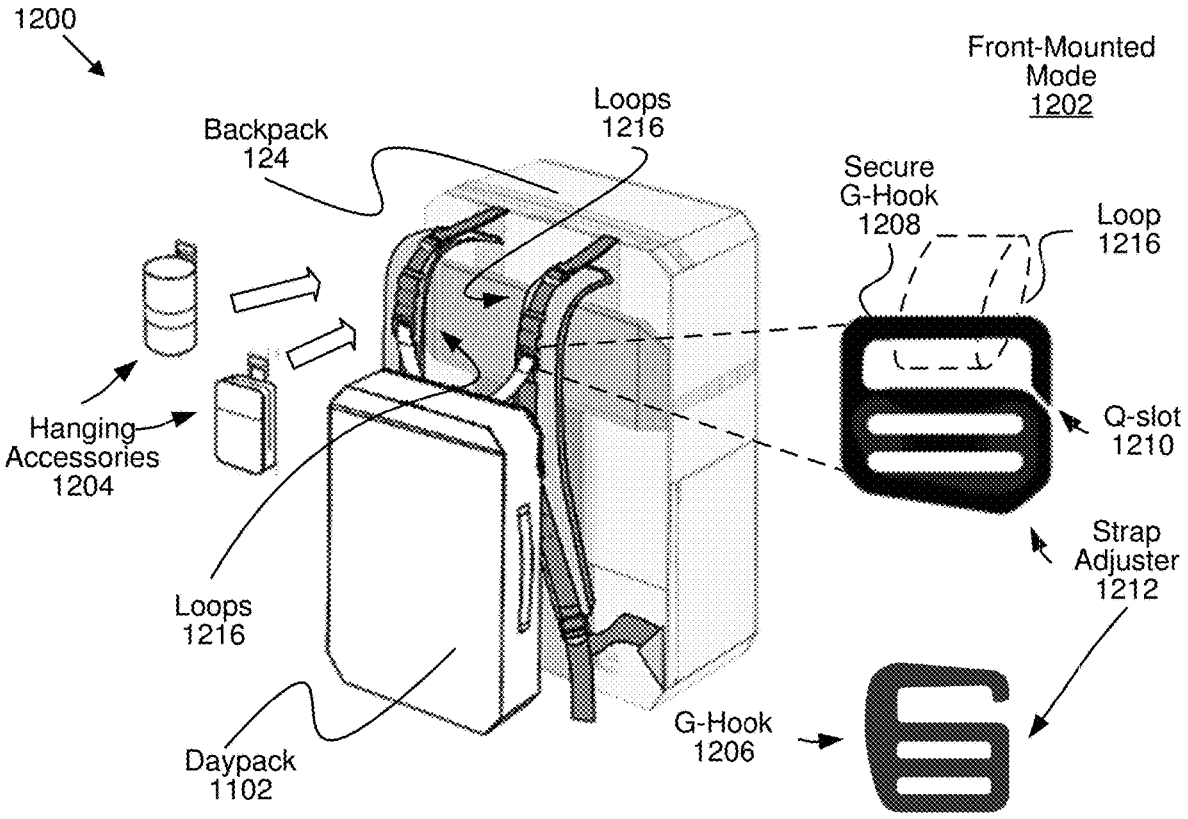
FIG. 12A is a perspective view of a convertible hip belt and backpack system with a daypack connected in a front-mounted mode to the backpack using g-hooks, according to one or more example implementations of the present disclosure.

FIG. 12A is a perspective view of a system 1200 that includes the convertible hip belt (not shown), the backpack 124, and the daypack 1102 connected in a front-mounted mode 1202 to the backpack 124.

In some example implementations, the backpack system 1200 includes separable fasteners that are configured to couple the compressible daypack to an outward-facing front portion of the shoulder straps 904 (shown in FIG. 9) of the carry-on backpack 124 and/or to an outward-facing back portion of the carry-on backpack 124.

In certain example implementations, the separable fasteners include g-hooks 1206 or secure g-hooks 1208. The g-hooks 1206 or the secure g-hooks 1208 are configured to securely attach the daypack 1102 to any of several loops 1216 sewn or otherwise disposed along a front surface of the shoulder straps of the backpack 124. Other items such as the hanging accessories 1204 may be attached to the loops 1216 in addition to, or instead of, the daypack 1102. Both the g-hook 1206 and the secure g-hook 1208 are depicted as having strap adjusters 1212. The g-hook 1206 has an opening that may more easily allow it to slip off the loop 1216. The secure g-hook 1208 includes a downward-angled Q-slot 1210, also referred to herein as a "Q-slot opening." Because the Q-slot 1210 is downward-angled, the risk of the secure g-hook 1208 sliding off the loop 1216 is reduced. Nevertheless, the secure g-hook 1208 may be easily decoupled from the loop 1216 by the user merely twisting the secure g-hook 1208 so that the angle of the loop fabric aligns with the angle of the Q-slot 1210.

Figure 12B:
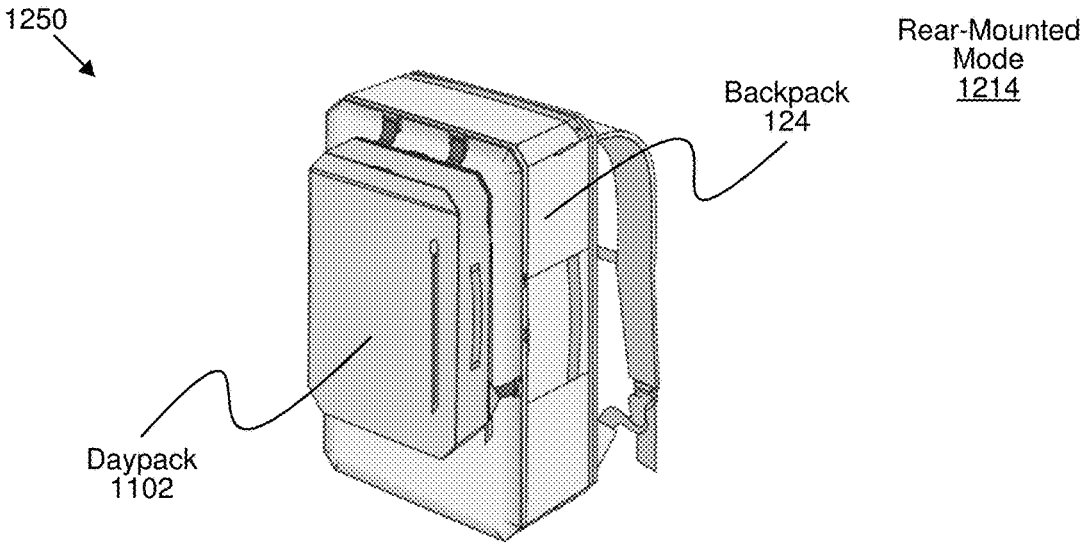
FIG. 12B is a perspective view of a convertible hip belt and backpack system with a daypack connected in a rear-mounted mode to the backpack using g-hooks, according to one or more example implementations of the present disclosure.

FIG. 12B is a perspective view of a convertible hip belt and backpack system 1250 that also includes a daypack 1102. The system 1250 is substantially similar to the system 1200 described above with respect to FIG. 12A except that the daypack 1102 is connected in a rear-mounted mode 1214 (also referred to as a "piggyback" mode) to the backpack 124 using the g-hooks 1206 or the secure g-hooks 1208.

Although the convertible hip belt 102 is not depicted in FIGS. 12A and 12B, it is in certain example implementations, an important component of the systems 1200, 1250, for all the reasons described above with respect to FIGS. 1-9 as well as for the reason that with the daypack 1102 mounted to the front or rear of the backpack 124, the additional weight of the daypack 1102 can be beneficially supported by the convertible hip belt 102 in the backpack mode 104.

In other example implementations, the systems 1200 and 1250 include a backpack having a main compartment and right and left shoulder strap, a convertible hip belt having a backpack mode and an independent mode. In the backpack mode, the convertible hip belt includes a right hip pocket and a left hip pocket individually having a strap at a strap end and a pocket connector at a pocket-attaching end, the pocket connector detachably couplable to respective side portions of a lower back panel of the backpack. The convertible hip belt includes a separable fastener that adjustably couples the strap end of the right hip pocket to the strap end of the left hip pocket such that an inward-facing back of the right and left hip pockets are configured to support at least a portion of a load within the backpack against a portion of the waist of a user. In the independent mode, the convertible hip belt is decoupled from the backpack at the pocket connectors of the right and left hip pockets and the pocket connectors are instead couplable to each other.

Various additional example implementations are depicted in appendices A, B, and C submitted herewith which individually and collectively form part of the present disclosure. Appendix A includes various drawings and descriptions of the convertible hip belt which may be referred to as a sling bag when in the independent mode. Appendix B includes many drawings and descriptions of the backpack to which the convertible hip belt is configured to attach. Appendix C includes certain drawings and descriptions of the daypack which is configured to attach to the backpack of the systems described herein, with or without the convertible hip belt being coupled to the backpack.

The present invention may be embodied in other specific forms without departing from its spirit or essential characteristics. The described example implementations are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a convertible hip belt having a backpack mode and an independent mode, wherein in the backpack mode, the convertible hip belt comprises:

a right hip pocket and a left hip pocket individually having a strap at a strap end and one or more pocket connectors at a pocket-attaching end, the one or more pocket connectors detachably couplable to a complementary connector on a back panel of a backpack; and a separable fastener that adjustably couples the strap of the right hip pocket to the strap of the left hip pocket such that an inward-facing back of the right hip pocket and/or the left hip pocket is configured to support at least a portion of a load within the backpack against a portion of the waist of a user, wherein, the one or more pocket connectors of the individual hip pockets comprise a zipper connector for connecting a main pocket of each hip pocket to a complementary zipper connector, and in the independent mode, the convertible hip belt is decoupled from the backpack at the one or more pocket connectors of the right hip pocket and the left hip pocket and the one or more pocket connectors are instead couplable to each other.

2. The apparatus of claim 1, wherein the one or more pocket connectors of the individual hip pockets comprise a buckle connector for connecting a cushion of each hip pocket to a complementary buckle connector.

3. The apparatus of claim 1, wherein the right hip pocket and/or the left hip pocket individually comprise a front-access pocket on an outward-facing portion of a main pocket.

4. The apparatus of claim 1, wherein the right hip pocket and/or the left hip pocket individually comprise a cushion attached to the inward-facing back of the right hip pocket and/or the left hip pocket.

5. The apparatus of claim 4, further comprising a flap at the strap end of the cushion configured to enable the strap to be tightly coupled and to reduce a risk of subjecting objects in a main pocket to a damaging bending force.

6. The apparatus of claim 4, further comprising a sleeve formed between an individual hip pocket and the cushion attached to the inward-facing back of the individual hip pocket.

7. The apparatus of claim 4, wherein a main pocket of an individual hip pocket and/or a sleeve formed between the main pocket and the cushion are configured to hold one or more fluid containers.

8. The apparatus of claim 1, wherein the main pocket and/or a front-access pocket comprise a leak-resistant interior surface and/or a leak-resistant closure.

9. The apparatus of claim 8, wherein the leak-resistant closure comprises a welded zipper.

10. The apparatus of claim 1, wherein an access zipper of the main pocket extends from one or more right-angled corners at the pocket-attaching end along a top edge and along a side edge at the strap end to terminate at a top point of a beveled corner at a bottom of the strap end such that the beveled corner at the bottom is configured to prevent items in a bottom portion of the main pocket from sliding out an outer side of the main pocket.

11. The apparatus of claim 1, wherein an access zipper of the main pocket and/or a front-access pocket comprises a zipper pull with a finger hole sized to allow a fingertip to pass through.

12. The apparatus of claim 1, wherein the main pocket comprises a gusset configured to expand and/or compress based on a total size of items stored within the main pocket.

13. The apparatus of claim 1, wherein, in the independent mode, one or more of the straps of the convertible hip belt are adjustable in length to facilitate wearing the convertible hip belt in a plurality of modes comprising an elbowed sling bag mode, a front-facing sling bag mode, a back-facing sling bag mode, a fanny pack mode, a purse mode, and a hand-tote mode.

14. The apparatus of claim 1, wherein, in an elbowed sling bag mode, respective zipper pulls of the zipper connectors of the right hip pocket and the left hip pocket are slid to a top position such that right and left hip pockets hang from a shoulder of the user to form an elbow shape by being partially decoupled at a bottom edge of the pocket-attaching end.

15. The apparatus of claim 1, wherein, in the independent mode, instead of the right hip pocket and the left hip pocket being coupled to each other at the pocket-attaching end, the pocket connector at the pocket-attaching end of either the right hip pocket or the left hip pocket is coupled to a complementary fastener at the strap end of the same hip pocket so as to form a single pocket sling bag.

16. The apparatus of claim 1, wherein the separable fastener and/or the one or more pocket connectors comprises a side-release buckle.

17. A system comprising:

a carry-on backpack having:

a main compartment having one or more clamshell accesses with corresponding zippered closures; and right and left shoulder straps attached to the main compartment;

a convertible hip belt having a backpack mode and an independent mode, wherein in the backpack mode, the convertible hip belt comprises:

a right hip pocket and a left hip pocket individually having a strap at a strap end and a pocket connector at a pocket-attaching end, the pocket connector detachably couplable to respective side portions of a lower back panel of the carry-on backpack;

a side-release buckle that adjustably couples the strap end of the right hip pocket to the strap end of the left hip pocket such that an inward-facing surface of the right hip pocket and/or the left hip pocket is configured to support at least a portion of a load within the backpack against a portion of the waist of a user; and wherein, the one or more pocket connectors of the individual hip pockets comprise a zipper connector for connecting a main pocket of each hip pocket to a complementary zipper connector, and, in the independent mode, the convertible hip belt is decoupled from the carry-on backpack at the pocket connectors of the right and left hip pockets and the pocket connectors are instead couplable to each other.

18. The system of claim 17, wherein the side-release buckle and the straps of the right and left hip pockets are sufficiently thin so as to allow a seatback tray table to be closed and latched with the convertible hip belt in the independent mode strapped around the seatback tray table to facilitate access to items in the right hip pocket and/or the left hip pocket.

* * * * *